US008695277B2

(12) United States Patent
Römer et al.

(10) Patent No.: US 8,695,277 B2
(45) Date of Patent: Apr. 15, 2014

(54) DOOR ACTUATOR

(75) Inventors: Martin Römer, Breckerfeld (DE); Michael Hufen, Wuppertal (DE); Holger Hänsch, Witten (DE); Matthias Drux, Gevelsberg (DE); Michael Glanz, Langenfeld (DE); Dietmar Finis, Remscheid (DE); Thomas Wildförster, Schwelm (DE)

(73) Assignee: Dorma GmbH + Co. KG, Ennepetal (DE)

( * ) Notice: Subject to any disclaimer, the term of this patent is extended or adjusted under 35 U.S.C. 154(b) by 674 days.

(21) Appl. No.: 12/742,891

(22) PCT Filed: Nov. 13, 2008

(86) PCT No.: PCT/EP2008/009581

§ 371 (c)(1), (2), (4) Date: May 13, 2010

(87) PCT Pub. No.: WO2009/062709

PCT Pub. Date: May 22, 2009

(65) Prior Publication Data

US 2010/0263284 A1 Oct. 21, 2010

(30) Foreign Application Priority Data

| | | |
|---|---|---|
| Nov. 13, 2007 | (DE) | 10 2007 054 460 |
| Nov. 13, 2007 | (DE) | 10 2007 054 462 |
| Nov. 13, 2007 | (DE) | 10 2007 054 463 |
| Nov. 13, 2007 | (DE) | 10 2007 054 464 |
| May 7, 2008 | (DE) | 10 2008 022 714 |

(51) Int. Cl.
*E05F 15/02* (2006.01)

(52) U.S. Cl.
USPC ..... 49/340

(58) Field of Classification Search
USPC ..... 49/339, 340
See application file for complete search history.

(56) References Cited

U.S. PATENT DOCUMENTS

| | | | | |
|---|---|---|---|---|
| 2,460,369 | A * | 2/1949 | Stronach | 16/56 |
| 5,392,562 | A * | 2/1995 | Carambula | 49/346 |
| 6,205,615 | B1 * | 3/2001 | Jensen et al. | 16/71 |
| D463,728 | S * | 10/2002 | Johnson | D8/349 |
| 7,143,547 | B2 * | 12/2006 | Liles, Jr. | 49/340 |
| 7,316,096 | B2 * | 1/2008 | Houser et al. | 49/345 |
| 7,484,333 | B2 * | 2/2009 | Houser et al. | 49/506 |
| 7,698,796 | B1 * | 4/2010 | Dowling et al. | 29/402.08 |
| 7,774,984 | B2 * | 8/2010 | Hsu | 49/341 |

(Continued)

FOREIGN PATENT DOCUMENTS

| | | |
|---|---|---|
| DE | 43 43 695 | 6/1995 |
| DE | 195 01 432 | 7/1996 |

(Continued)

*Primary Examiner* — Jerry Redman
(74) *Attorney, Agent, or Firm* — Cozen O'Connor

(57) ABSTRACT

A door operator to be disposed at a door leaf, a door frame, a door transom, or a wall, with at least one mounting plate, on which the door operator assembly is disposed. The assembly has a modular design and has at least one connector module, a drive module and a main module, which are latched onto the mounting plate by latching elements. The main module includes a system carrier, which accommodates at least one supply unit and at least one control unit, fastened by latching elements.

25 Claims, 20 Drawing Sheets

(56) References Cited

U.S. PATENT DOCUMENTS

| | | | | |
|---|---|---|---|---|
| 8,109,038 | B2 * | 2/2012 | Houser et al. | 49/345 |
| 8,225,458 | B1 * | 7/2012 | Hoffberg | 16/49 |
| 2002/0007564 | A1 * | 1/2002 | Myers et al. | 33/566 |
| 2005/0178066 | A1 * | 8/2005 | Drux et al. | 49/340 |
| 2007/0256362 | A1 * | 11/2007 | Hansen | 49/32 |
| 2008/0256862 | A1 | 10/2008 | Hansch et al. | |
| 2010/0175326 | A1 * | 7/2010 | Drux | 49/348 |
| 2010/0263284 | A1 * | 10/2010 | Romer et al. | 49/358 |
| 2010/0281777 | A1 * | 11/2010 | Romer et al. | 49/349 |

FOREIGN PATENT DOCUMENTS

| | | |
|---|---|---|
| DE | 203 20 657 | 11/2004 |
| DE | 20 2005 000543 | 3/2005 |
| DE | 10 2005 001314 | 7/2006 |
| EP | 1 801 339 | 6/2007 |

* cited by examiner

DOOR ACTUATOR

PRIORITY CLAIM

This is a U.S. national stage of application No. PCT/EP2008/009581, filed on 13 Nov. 2008, which claims Priority to the following German, Application Nos.: 10 2007 054 460.1, filed: 13 Nov. 2007; 10 2007 054 462.8, filed: 13 Nov. 2007; 10 2007 054 463.6, filed: 13 Nov. 2007; and 10 2007 054 464.4, filed: 13 Nov. 2007; the contents of which are incorporated here by reference.

BACKGROUND OF THE INVENTION

1. Field of the Invention

The present invention relates to a door operator disposed at a reception body, such as a door leaf, a door frame, a door transom, a wall or the like, with at least one mounting plate, on which the door operator assembly is disposed. The invention further relates to a mounting method for mounting the door operator.

2. Prior Art

Door operators of the species discussed here are intended for operating a door leaf of a door system and may be configured as door closers or as partially or fully automatic door operators. Most of the time the door operator is mounted at the top of a door transom or at a wall and is connected to the door via an arm assembly. Mechanically operating door operators are also known as door closers and typically have only a spring force accumulator, to perform the closing movement of the door leaf. Furthermore, electrical door operators are known which are either configured as electromotive or electro-hydraulic operators. With fully automatically configured door operators, for opening the door, the operators are activated most of the time by a momentary contact switch or a motion-sensor and they serve for executing both the opening procedure of the door leaf and the mostly time-delayed closing procedure. Furthermore, door operators are known which are connected to a power supply network of a building, in order to constitute a component of the safety equipment and in particular of the fire protection equipment, wherein the equipment can be activated centrally. Fully automatic door closers are common in particular in public buildings, as well as in the infrastructure of larger building complexes, which have a high volume of people passing through.

For installation purposes, the door operator has a mounting plate, which is connected to the reception body, namely a door transom, a wall or a door frame for example, by of screwing or any other known type of connection. Once the mounting plate is installed at the reception body, the door operator itself is mounted to the mounting plate. For mounting the door operator, the plate has pre-fabricated threaded bores or through-openings for screw-connections, in order to firmly connect the door operator to the wall or to the door frame via the mounting plate.

A mounting plate of this species for a door operator is known from Utility Model DE 20 2005 000 543 U1. The mounting plate is configured for a door closer and can be attached to a stable base. At the mounting side, the door operator assembly, as well as an associated cover can be mounted, wherein mounting plates, for door closers and/or door operators of the fully automatic type of construction, with varying degrees of automation, are very often similarly executed.

Very often, mounting the door operator to the mounting plate needs to be performed in a non-ergonomic working position. For this procedure, overhead work is required, where a door operator with a high degree of automation may have a considerable weight. Known door operator assemblies have a considerable installation expense and it is very often that the installation can be done only on-site, when mounting the door operator to the door system. As a result, a plurality of special tools may be required which furthermore, depending on the type of construction of the door operator, need to be differently assorted.

SUMMARY OF THE INVENTION

Consequently, a requirement arises for a simplified door operator assembly to facilitate the installation on-site for the mechanic. In addition to mounting the door operator on-site, it is desirable to improve the exchangeability of individual modules of the door operator such that, depending on the degree of automation of the door operator, individual modules may be removed or added, without interfering with the overall functioning of the door operator, or for being able to replace any possibly defective parts.

It is an object of the present invention to provide a door operator which allows for both a simple mounting method in the factory and a simple mounting on-site for installing it at the door system, and to provide a method for mounting such a door operator.

According to embodiment of the invention the door operator has a modular structure and comprises at least one connector module, a drive module and a main module, wherein the modules are latched onto the mounting plate by associated latching elements, and wherein the main module comprises a system carrier, which receives at least one supply unit and at least one control unit by associated latching elements. Consequently, the mounting plate is configured to be fastened to the reception body and the door operator is fastened to the mounting plate. The main module comprises a system carrier, in which at least one supply unit and at least one control unit are received by associated fastening elements. This results in relatively few modules to be attached to each other.

With the inventive structure of the door operator, consisting of different modules, the mounting plate can be fastened to the door frame or to the wall, wherein the door operator can be assembled subsequently in a flexible manner and according to the required specifications, in order to then place the required modules on the mounting plate. Latching elements are associated to the different modules for this purpose, such that the connector module, the drive module and the main module are individually or jointly latchable onto the mounting plate. The latching can be configured such that the individual modules can be repeatedly released from the mounting plate without having to utilize additional tools for this purpose. According to a modular principle, the person, dealing with the door operator installation, can clip the individual modules onto the mounting plate either simultaneously or in a timely sequence by the latching elements, such that the latching elements already retain the modules on the mounting plate. As a consequence, this results in a considerably simplified mounting method, because the person dealing with the mounting does not need to hold the door operator with one hand, and screw it to the mounting plate with a tool in the other hand. Likewise, a possible adaptation of the door operator to a given building space, as well as to the required specifications for operating the door system, may be realized even during the installation on-site by the created modular system, without prior supply of a specific door operator.

Advantageously, fastening elements, preferably in the shape of latching elements, are provided between the connector module, the drive module and/or the main module, to allow for latching the individual modules onto each other. Thereby the door operator assembly, i.e. a thus created drive unit, can be completed already prior to the latching procedure onto the mounting plate, such that the modules can be electrically connected to each other in a simplified manner after the latching procedure. After the pre-assembly, the structure is latched onto the mounting plate by the above mentioned latching elements. Latching the individual modules both onto each other and onto the mounting plate offers a considerable gain in time, because cumbersome screwing, at least during the preparation of the assembly, can be omitted. This way, either the drive unit can be completed on the premises of the manufacturer and thus during delivery and thereupon subjected to a final inspection and, if required, to a performance test. However, this may be also realized on-site, for example at a construction site, in that the mechanic is able to complete the drive system without requiring any tools, and especially without any additional knowledge, by simply effecting the latching of the modules, whereupon he disposes them on the mounting plate.

Furthermore, it may be provided that respectively associated screw connections, having screw elements, which are disposed in a captive way by a screw reception at the respective modules, are intended between the modules and the mounting plate. In the modules, the screw receptions may concern channel-like breakthroughs with a retaining collar. The screw elements may be retained either by the retaining collar itself or comprise a retaining disc, by which the screw elements are held in the modules in a captive way. the factory the modules may be provided with the required screw elements, preferably in the shape of attachment screws. Therefore, on-site, the mechanic does not have to fiddle around and get the required screws out of a bag and insert them into the provided holes in the door operator. As a consequence, simply one appropriate tool, such as a screw driver is required in order to screw the screws into the threaded bores, which are milled in the mounting plate.

The mounting plate may have a multitude of threaded bores, which are positioned in the mounting plate to allow for a flexible and arbitrary disposition of different modules. By providing the required screw elements, mounting the assembly onto the mounting plate is even more simplified. The mechanic does not have to support the weight of the assembly, nor is it necessary to provide additional suitable screw elements.

According to one embodiment of the invention, the main module comprises a system carrier, which accommodates at least one supply unit and a control unit, again by associated fastening elements. As a consequence, the supply unit and the control unit do not have to be connected to each other by further connecting elements and required tools, such that the overall system of the assembly, except for the final screwing of the assembly to the mounting plate, is realized by latching elements.

Preferably the supply unit is configured as a power supply unit. It is furthermore preferred to provide an angular and/or basket-shaped reception element, in which the power supply unit is placed and, from the direction of the mounting plate, disposed at the system carrier by associated fastening elements, comprising for example at least one latching nose and/or latching recess at the reception element and corresponding latching recess(es), respectively latching nose(s) at the system carrier.

All latching elements may be configured such as to allow for a random number of repeated releases. The supply unit may comprise a power supply unit, wherein an angular and/or basket-shaped reception element is provided in which the power supply unit may be placed. The power supply unit, together with the reception element, forms a compact and individually manageable structural component, wherein the latching elements of the power supply unit are advantageously provided at the reception element. These latching elements may comprise at least one latching nose at the reception element and one latching recess at the system carrier such that the supply unit with reception element as well can be clipped to the system carrier in the simplest manner. The joining direction of the supply unit in the system carrier is realized from the direction of the mounting plate such as to initially dispose the supply unit at the system carrier and to only subsequently position the system carrier on the mounting plate.

According to another advantageous embodiment, the control unit is latchable onto the system carrier from the direction opposite to the mounting plate, preferably by associated latching elements. At the system carrier, these latching elements may have arresting projections and, complementary thereto, recesses in a circuit board carrier of the control unit. Therefore, the control unit points towards the upper side direction, if the door operator assembly is positioned on the underside of the mounting plate. As a consequence, the control unit and the supply unit are preferably loaded into the system carrier from respectively opposite directions and are latched onto the latter. This allows for mounting the power supply unit and control unit at the system carrier independently from each other. Furthermore, the power supply unit and the control unit are thereby accessible, without having to first remove the respective other component, namely the control unit or the power supply unit, which allows for a flexible mounting and a simplified exchange of possibly defective parts.

For improved reception of the control unit at the system carrier, the arresting projections of the latching elements may comprise joining slants, which, when placing the circuit board carrier, slide along corresponding borders of the circuit board carrier. In this case, the arresting projections are resiliently pushed back, preferably laterally with regard to the joining direction. The arresting projections are undercut by adjacent holding recesses, such that the circuit board carrier, by its border, is latchable in the holding recesses. If the control unit is removed again, the arresting projections can be pushed back manually such that the circuit board carrier of the control unit is released again from the holding recesses. The arresting projections are preferably provided as plate-shaped formings at the system carrier. They have a tongue shape, in order to get a bending elasticity. In case the control unit is defective, a mechanic can exchange it manually in a simple manner. For this purpose, simply manipulating the arresting projections is required, wherein the control circuit board can be contacted with an external cabling, which is connected to the control unit via multipole-connectors and clamping screws.

Another improvement of the disposition of the control unit on the system carrier is achieved in that the system carrier has carrying projections on the upper side, against which the circuit board carrier can be brought to abut, once it latches in the holding recesses. At the system carrier, the carrying projections are preferably provided as web-like formings, wherein the overall system carrier may be made from plastic material and manufactured in a plastic injection moulding process.

Furthermore it may be intended that the latching elements for latching the modules onto the mounting plate comprise pilot pins which are disposed on the mounting plate and vertically protrude from the latter. The pilot pins may be screwed, welded, soldered or in particular riveted to the mounting plate. The pilot pins may have a cylindrical shape such as to create a guiding area in order to dispose the modules in a precise position on the mounting plate. If the modules are placed onto the mounting plate, the pilot pins extend into complementarily configured pilot pin receptions within the modules, whereby a precise positioning of the modules is achieved on the mounting plate. The cylindrically shaped pilot pins may have latching recesses, in which latching projections are latched within the pilot pin receptions, when the modules are placed onto the mounting plate and the pilot pins are introduced into the pilot pin receptions. The latching recesses are configured to have an operative connection with the latching projections within the pilot pin receptions such that a positive retaining of the modules on the mounting plate is certainly enabled by the pilot pins, but releasing the modules again from the mounting plate can be performed at any time.

According to another embodiment, the latching elements between the connector module and the drive module comprise at least one slip-on projection preferably at the drive module, wherein the latching elements, at the connector module correspondingly comprise preferably at least one slip-on recess, into which the slip-on projection can be pushed-in from the joining direction. Preferably at least two slip-on projections may be provided which can be slid into two associated slip-on recesses. The operative connection between the slip-on projections and the slip-on recesses is realized according to the type of a tongue-and-groove joint. As joining the connector module onto the drive module is realized in the direction of the mounting plate, the drive module may be fixed already on the mounting plate, such that the connector module can be only subsequently placed onto the drive module and can be removed again a random number of times.

The latching elements, between the drive module and the main module, advantageously comprise at least one latching projection at the drive module, whereas the latching elements at the main module comprise at least one latching tongue which connects the drive module to the main module by latching on the latching projection. The joining between the drive module and the main module is realized in a parallel direction to the longitudinal extension of the mounting plate, respectively of the entire drive unit. In this case, either the drive module or the main module may be connected already to the mounting plate such that the joining connection between the drive module and the main modules is done later. The drive module may have a spring force accumulator as well as a motor, wherein, when joining the drive module to the main module, the spring force accumulator can be introduced into a complementary reception tunnel within the main module. Furthermore, the main module has a reception bed which is provided in the system carrier of the main module, complementary to the motor of the drive module. Thereby an additional reinforcing of the joining connection is allowed between the drive module and the main module, wherein the dimension tolerances between the reception tunnel and the spring force accumulator, as well as the reception bed and the motor may be dimensioned such that a clamping action of the drive module at the main module is achieved.

It is furthermore preferred the drive module and/or the system carrier comprise fastening and/or clamping elements which are configured to receive, respectively to retain in a fixed or clamping manner, predetermined sections of a voltage supply line laid from the connector module to the supply unit. In a simple way it is thereby possible to provide the power supply unit with the required voltage supply. Fixing, respectively clamping the voltage supply line allows for a reliable installation.

Preferably the door operator has a spring force accumulator which is adapted to close a connected door. The system carrier comprises fastening elements which are adapted to stationarily receive a device for adjusting a pre-tension of a closer spring of the spring force accumulator. It is thereby possible to individually mount the closer spring pre-tension adjusting device and the spring force accumulator, and to optimize each.

The spring force accumulator, at an end facing away from the gear of the drive module, preferably comprises a first transmission device. This first transmission device has a shaft which, at least at one section facing the closer spring, comprises a threaded section. It comprises furthermore a first gear member, for example in the shape of a bevel gear or a crown wheel, which is disposed at or conformed torque-proof to an end of the shaft, which end is accessible from outside with regard to the spring force accumulator. Finally it has a spring abutment, at which an end of the closer spring, facing away from the gear, is supported and which, by a threaded section, which is configured complementary to the threaded section of the shaft, is screwed onto the threaded section of the shaft from the direction of an end of the shaft facing away from the gear. Thereby a spring abutment is formed, which, together with the end of the closer spring supported at it, is translationally moving in the spring force accumulator on account of a rotation of said shaft, and which is thus able to change the pre-tension of the closer spring.

It is furthermore preferred the closer spring pre-tension adjusting device presents a mounting bracket which has fastening elements that are configured to be stationarily affixed to the fastening elements of the system carrier. In this case, in the installed condition, the closer spring pre-tension adjusting device is in operative engagement with the first gear member. The fastening elements of the mounting bracket are preferably formed by slide-in projections. Accordingly, the fastening elements of the system carrier are formed by correspondingly configured grooves. Thus, the closer spring pre-tension adjusting device is mountable in a simple manner by sliding it into and possibly clamping it to the system carrier.

Preferably a plate-shaped member is configured at or mounted to the mounting bracket, which member extends transversely to a longitudinal extension of the spring force accumulator. The above mentioned fastening elements of the mounting bracket are in this case advantageously configured at sides of the plate-shaped member adjacent to the system carrier. In this case, the mounting bracket has preferably one or two wall sections or branches which are configured parallel to each other. An associated shaft of the adjusting device is freely rotatably supported and received in the at least one wall section or branch. The shaft at its one end, facing an inner compartment of the mounting bracket, has a torque-proof disposed second gear member of the adjusting device, which is in rotational engagement with the first gear member. Adjusting elements, which are in operative engagement with the aforementioned first gear member, are torque-proof disposed at the other end of the shaft, facing away from the inner compartment of the mounting bracket.

Preferably the second gear member has the shape of a bevel gear, a cylindrical gear or a friction wheel, depending on the configuration of the first gear member.

The shape of the adjusting device provides that the force of the adjusting elements is transferred to the spring abutment at an angle of preferably 90°. It is thereby possible to lead the adjusting elements, which have the shape of a disc for example, with a screw section for example in the shape of a hexagon socket or the like, out of the door operator laterally with regard to the longitudinal extension of the spring force accumulator and to make it thereby accessible. In addition, in particular in the event of a U-shaped mounting bracket, it is possible to dispose two adjusting elements towards two opposite sides of the door operator. Thereby, one adjusting elements is always accessible, even if the door operator is mounted for example close to a ceiling.

The fastening elements, between the connector module and the drive module, comprise preferably at least one slip-on projection by way of example at the connector module or the drive module, and at the drive module, respectively at the connector module, they comprise correspondingly at least one slip-on recess, into which the slip-on projection can be slid from the joining direction.

Between the drive module and the main module, the fastening elements comprise at least one latching projection at the drive module and correspondingly at least one latching tongue at the main module. As a consequence, the latching tongue connects the drive module to the main module by latching onto the latching projection.

Furthermore, the present invention is directed to a mounting method for a door operator to be disposed at a door leaf, at a door frame, at a door transom, at a wall or the like. Mounting the door operator is realized via the mounting plate on which the door operator assembly is disposed. According to the invention it is intended that at first the mounting plate is affixed to the door frame, to the door transom, to the wall or the like. In this case, the affixing may be realized by screwing; pre-drilled through-holes are provided in the mounting plate for this purpose. Furthermore, it is intended to fit the connector module, the drive module and the main module onto the mounting plate, the modules being retained on the mounting plate by pilot pins, and wherein the method is realized by at least screwing the modules to the mounting plate by screw elements.

The method thus mainly comprises the steps of affixing the mounting plate at the reception body, placing the door operator onto the mounting plate and screwing the modules to the mounting plate by screw elements. Placing the door operator onto the mounting plate includes fitting the connector module, the drive module and the main module onto the pilot pins of the mounting plate as the first fit-on component such that the modules are retained on the mounting plate by the pilot pins. Thereby, just by placing the door operator, the latter is preliminarily fixed, which simplifies the subsequent work, because the mechanic or helper does not have to continue to hold the door operator.

Prior to fitting the door operator onto the mounting plate, the connector module is preferably placed or fitted onto the drive module and the system carrier onto the drive module. Thus, the entire door operator can be mounted and therefore can be manufactured in advance, prior to being placed onto the mounting plate.

Furthermore, once the modules are fastened, respectively affixed to each other, the mounting method comprises installing the voltage supply line from the connector module to the supply unit by fixing it to the fastening or clamping elements at the connector module and/or the system carrier and furthermore connecting the voltage supply line to the supply unit.

Preferably prior to the step of placing the door operator onto the mounting plate, the mounting method furthermore comprises the step of inserting the supply unit into a reception compartment of the system carrier provided for this purpose. Thereby, the system carrier can be mounted, once having mounted the supply unit. The supply unit does not have to be inserted in a cumbersome manner, once having mounted the system carrier.

If the door operator comprises the above described closer spring pre-tension adjusting device with a mounting bracket, it is furthermore preferred the inventive mounting method, prior to the step of fitting the connector module onto the drive module, comprises a step of inserting the mounting bracket into at least one recess of the system carrier and a step of fastening the mounting bracket to the system carrier by the fastening elements.

Advantageously the step of inserting the mounting bracket into the at least one recess of the system carrier simultaneously results in bringing the first gear member into engagement with the at least one second gear member.

It is furthermore preferred the inventive mounting method comprises the steps of inserting the control unit into the provided fastening elements of the system carrier and of connecting the control unit to the supply unit. These steps can be performed independently from the other steps and thus already during manufacturing.

Subsequently to the step of inserting the control unit, it is furthermore preferred the inventive mounting method comprises a step of connecting the control unit to a connecting circuit board disposed at the connector module. The connecting circuit board may be provided for example to connect other components, such as sensors, etc. It is thereby possible to unite all external connections of the door operator in one location within the door operator, which offers the possibility to introduce cables into the reception body at a single location, for example a wall.

Preferably at least one of the steps of fitting one of the respective modules on the associated component, of inserting the supply unit into the reception compartment of the system carrier, of inserting the mounting bracket into at least one recess of the system carrier or of inserting the control unit into provided fastening elements of the system carrier, results in latching the respective inserted component onto the respective associated insert member. In an extreme situation, there are no additional fastening elements except the ones for affixing the mounting plate at the reception body. Latching the modules onto each other is realized in an advantage manner prior to fitting the modules onto the mounting plate.

BRIEF DESCRIPTION OF DRAWINGS

Hereinafter, further, the invention enhancing measures will be described in detail in conjunction with the description of one preferred embodiment of the invention based on the Figures, in which:

In a perspective view, FIG. 1 shows an embodiment of the inventive door operator 1, wherein the door operator 1 is illustrated in a partial area of a main module 5. The main module 5 consists of a carrying body 6, which is identified as system carrier 6 and preferably consists of an injection moulded structural component. The system carrier 6 is preferably configured in one piece and has a multitude of latching element 10, to be able to dispose additional components at the system carrier 6 without requiring additional connecting elements. The system carrier 6 is configured to be mounted in a latching manner to a mounting plate 2, a reception compartment 35 being provided in order to receive a supply unit 8 within the system carrier 6. The supply unit 8 is configured as a power supply unit 8 and is inserted into the reception compartment 35 of the system carrier 6 prior to mounting the system carrier 6 on the mounting plate 2. In this case, the latching is realized via the latching element 10, wherein latching noses 15 are preferably conformed to the power supply unit 8, which latch in latching recesses 16 corresponding to the noses, which recesses are preferably configured at the system carrier 6, such that the latching noses 15 and the latching recesses 16 form the latching element 10. This way, the power supply unit 8 is insertable into the system carrier 6 in a self-retaining manner.

Figure 1:
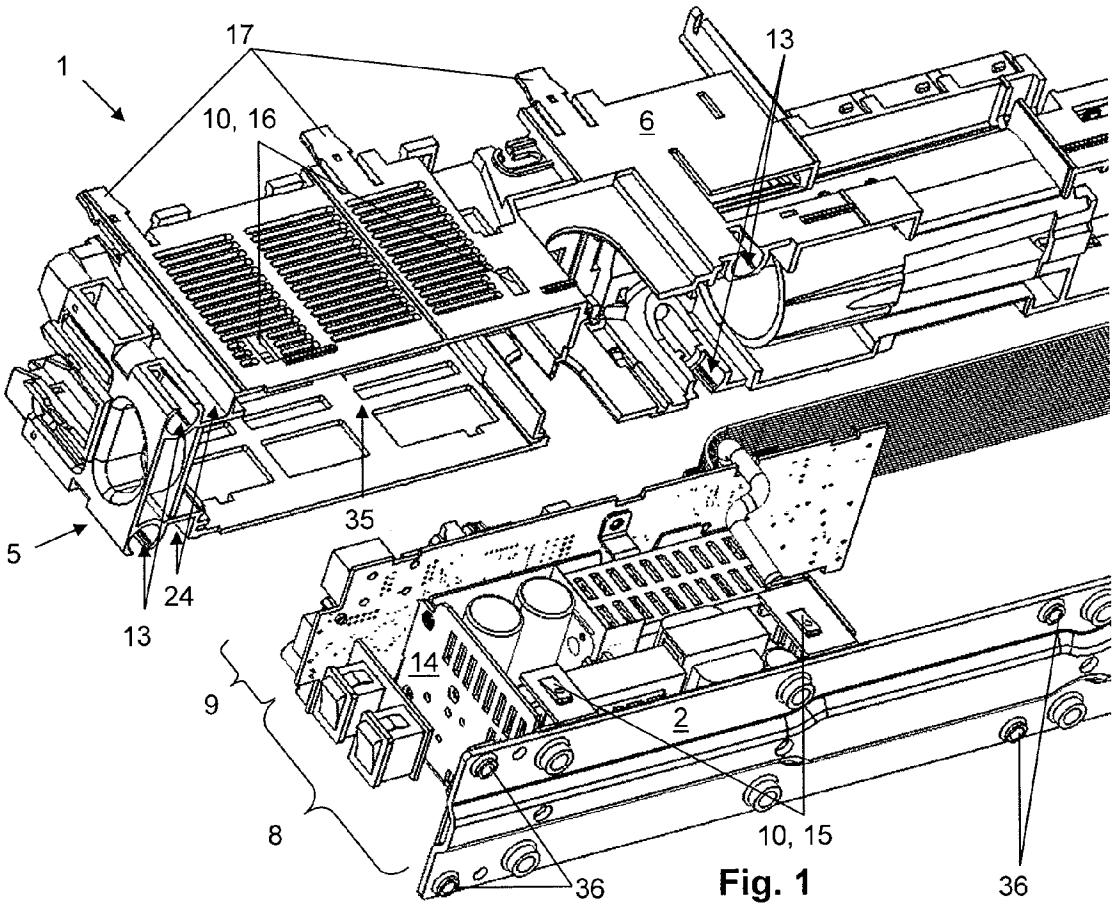
FIG. 1 is a perspective view of an embodiment of a door operator, wherein sections of the door operator are shown in the area of the system carrier.

A control unit 9, illustrated for a better view above the power supply unit 8, while the system carrier 6 is being displaced, is loaded into the system carrier 6 from the opposite direction and latched onto the latter via latching element 17. For latching the system carrier 6 on the mounting plate 2, pilot pins 23 —shown in FIG. 9*a*—are provided which can be introduced into pilot pin receptions 24, which are preferably provided in the system carrier 6. If the power supply unit 8 is inserted into the system carrier 6 and if the system carrier 6 is placed onto the mounting plate 2 and disposed in a self-retaining manner, screw elements 44, likewise not illustrated in FIG. 1, may be provided, which are placed preferably in a self-retaining manner via screw receptions 13 in the system carrier 6 and are screwed to the mounting plate 2 via respective threaded bores 36.

Figure 2:
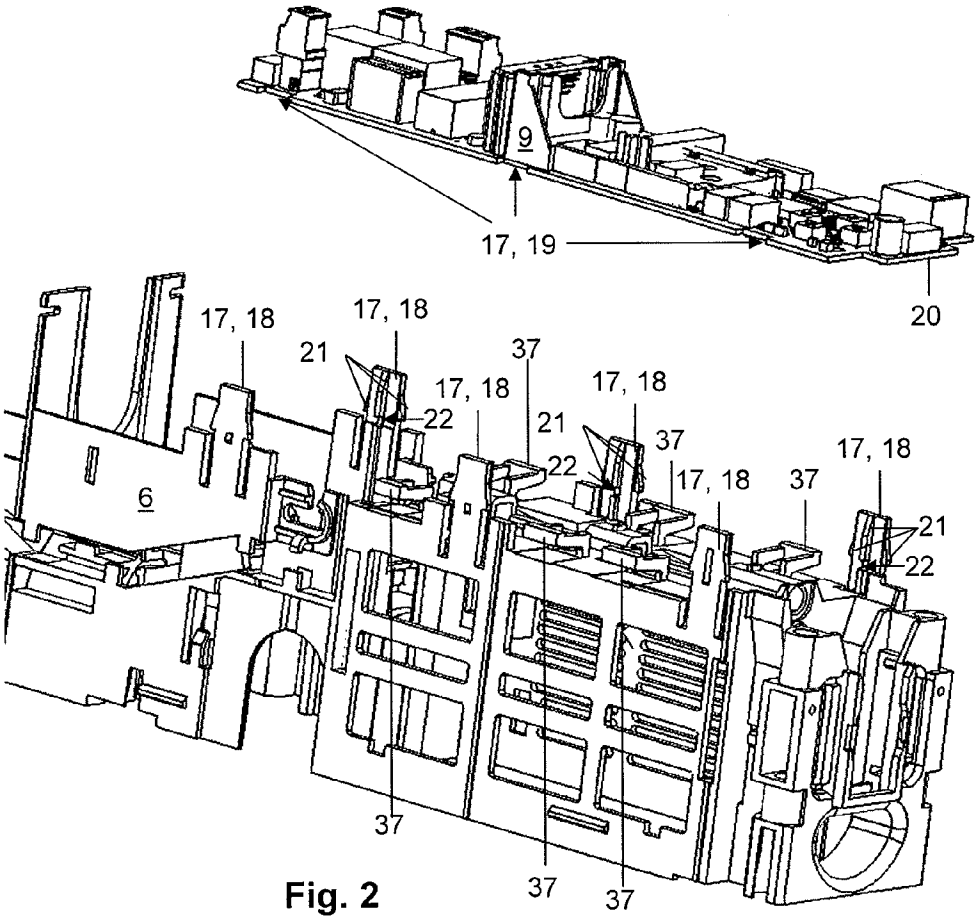
FIG. 2 is a perspective view of the system carrier with associated latching elements for disposing a control unit.

FIG. 2 shows the disposition of the control unit 9 at the system carrier 6 in a perspective view. The control unit 9 has a circuit board carrier 20, on which the control electronics are received. Latching the control unit 9 onto the system carrier 6 is preferably realized via latching elements 17, which are formed at the system carrier 6 by arresting projections 18, which can preferably engage in latching elements in the shape of recesses 19 in the circuit board carrier 20. Immobilizing the insert position of the circuit board carrier 20 is thereby possible at least in longitudinal direction of the system carrier 6.

It is furthermore preferred the arresting projections 18 of the latching elements 17 have joining slants 21, which, when placing the circuit board carrier 20, slide along the border of the circuit board carrier 20, in order to resiliently push the arresting projections 18 back laterally with regard to the joining direction. It is furthermore preferred the arresting projections 18 have holding recesses 22, which form undercuts for the joining slants 21 provided at the arresting projections 18. It is in these undercuts, that the circuit board carrier 20 is able to snap-in via the border thereof. By way of example, six arresting projections 18 are altogether provided at the system carrier 6, by which the control unit 9 is accommodated and retained. In order to create a support for the circuit board carrier 20 on the system carrier 6, the latter has preferably several carrying projections 37, which together provide a support plane for the circuit board carrier 20. The circuit board carrier 20 of the control unit 9 is thereby received above the system carrier 6 and secured to the latter.

In addition to the joining slants 21 oriented towards the system carrier inner compartment, additional joining slants 21 may be provided which protrude from the respective arresting projection in the direction of the longitudinal extension of the system carrier.

Figure 3A:
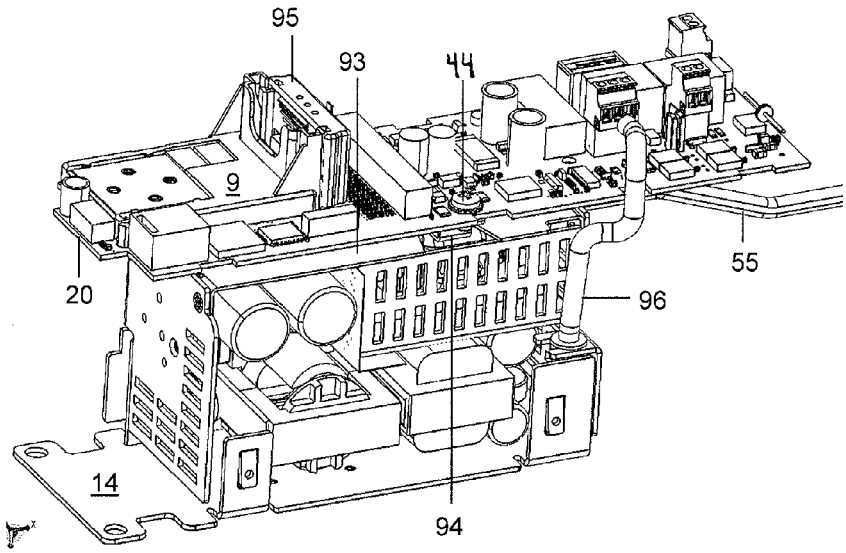
FIGS. 3*a* and 3*b* are two perspective views of the control unit and the supply unit of FIG. 1.
Figure 3B:
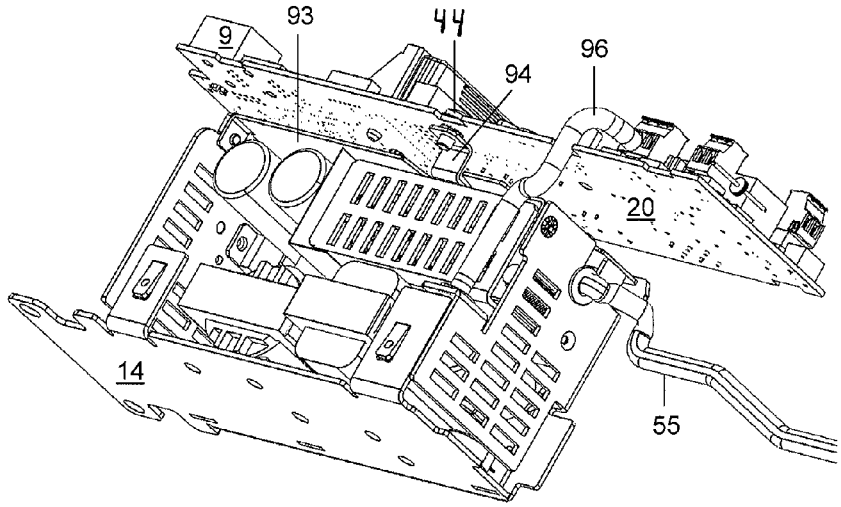

In two perspective views, FIGS. 3*a* and 3*b* show respectively the arrangement, comprising essentially the supply unit 8, respectively the reception element 14 and the control unit 9. Preferably the circuit board carrier 20 of the control unit 9 has an electrical connection for grounding the circuit board carrier 20 and thereby the control unit 9. The grounding connection is preferably configured by an invisible through-opening in the circuit board carrier 20, which has a metallic conducting outer ring, preferably at the upper side and/or underside with regard to the circuit board carrier 20. This through-opening is aligned with another through-opening, which is for example configured in a projection 94 of a screening sheet 93 of the reception element 14. The screening sheet 93 has the first purpose of electromagnetically screening the control unit 9 from the power supply unit 8. The screening sheet 93 is attached at the reception element 14 or integrally configured with the latter, as can be in particular well seen in FIG. 3*a*.

The other through-opening of the reception element 14 has preferably a female thread. Preferably one attachment screw 44 is screwed to the other through-opening by way of example from an upper side of the circuit board carrier 20 through the through-opening of the circuit board carrier 20, and the control unit 9 is grounded.

Once the reception element 14 is inserted and the control unit is placed onto the non-illustrated system carrier 6, the shown attachment screw 44 can be simply screwed into the projection 94, respectively the other through-opening thereof, which allows for a very simple installation.

For supplying voltage to the control unit 9, an internal voltage supply line, respectively a voltage supply cable 96 is guided from the power supply unit 8 to the control unit 9 and connected thereto. For the power supply to the power supply unit 8, which is received within the inner compartment of the reception element 14, a connecting cable 55 is guided by way of example through the reception element 14 on its front side to the power supply unit 8 and connected thereto.

The control unit 9 comprises a slot, not identified in detail, into which a first plug-in card 95 can be plugged. The first plug-in card 95 serves the purpose that the control unit 9 can detect which (additional) function(s) is/are enabled for the door operator 1. Examples of such functions are:

door hold-open
escape route control
emergency hold function
"automatic opening"
"push-and-go" function.

Functions according to the following indicated method can be enabled in the door operator 1 via such a first plug-in card 95. At first the first plug-in card 95, containing information on at least one function to be enabled, is plugged into the slot in the control unit 9. This information is transmitted to the control unit 9 for example by reading the plug-in card 95. Based on the transmitted information the control unit 9 determines the function to be enabled in the door operator 1. In this case, the control unit 9 generates a unique first identification code and transmits it to the first plug-in card 95, which stores the identification code. As an alternative, the control unit 9 itself stores the generated identification code in the plug-in card 95. Thereupon, the control unit 9 enables the at least one function to be enabled in the door operator 1.

If now another function is to be enabled, which can not be enabled by the first plugged-in plug-in card 95, the control unit 9 is furthermore adapted for the following method. At first the first plugged-in plug-in card 95 is removed from the slot. Thereupon a second plug-in card with information on at least one other function to be enabled is plugged in the slot. This information is now transmitted to the control unit 9. Again, based on the transmitted information, the at least one other function to be enabled is determined. Preferably it is again the control unit 9, which generates now a second identification code and transmits it, like before, to the second plug-in card, where the information is stored. The second plug-in card is preferably invalidated such as not to be utilizable for enabling the same function(s) in a door operator 1, which fact enhances the safety. The second plug-in card is now removed from the slot. Thereupon the first plug-in card 95 is plugged again in the slot. Now, the information transmitted from the second plug-in card and/or the generated second identification code is transferred to the first plug-in card 95 and stored therein. Finally the at least one other function is enabled in the door operator 1. The first plug-in card 95 thus becomes a module, in which all the information on all functions enabled in the door operator 1 are stored.

If the first plugged-in plug-in card 95 is now removed, without plugging-in another plug-in card or the first plug-in card 95 within a predetermined period of time, it is preferably intended that, after a predetermined period of time has elapsed, the control unit 9 cancels or blocks again all (additional) enabled functions.

The advantage of this solution is that all functions in the door operator 1, respectively in the control unit 9 are already implemented, which reduces unnecessary memory requirement in possible additional modules. Only a single plug-in card 95 and thus only a single slot is required in the door operator 1, which, in terms of available space, is advantageous.

Instead of being present in the control unit 9 or on the circuit board carrier 20, the slot may be configured or disposed at any other suitable location in the door operator 1. The logic circuitry for enabling functions in the door operator 1 may be likewise separate from the control unit.

Figure 4:
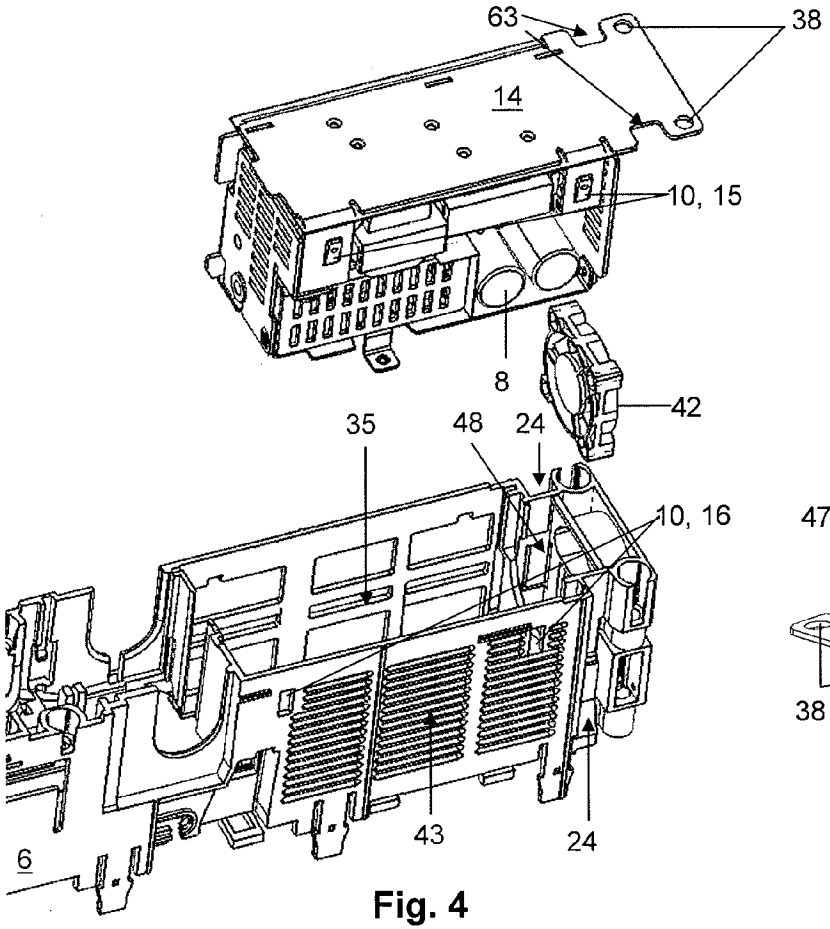
FIG. 4 is a perspective view of the system carrier for an underside mounting of a supply unit above a reception element.

FIG. 4 is a perspective view of the system carrier 6, in which the reception compartment 35 for receiving the supply unit 8 can be seen. The supply unit 8 is received at the system carrier 6 via a reception element 14, wherein the latching elements 10 for latching the supply unit 8 in the system carrier 6 are configured in the shape of latching noses 15 at the reception element 14. The noses latch in latching elements 10, representing latching recesses 16, provided at the system carrier 6. An active fan 42 for moving cooling air towards the supply unit, respectively away from it, may be inserted at an end side in the system carrier 6. Preferably a fan rack 48 is configured for this purpose in the system carrier 6, in which rack the fan 42 is inserted and, if required, is retained therein by clamping, latching, or the like.

The reception element 14 preferably has attachment openings 38, which attachment screws 44 pass through, which are not illustrated in FIG. 4 and are received in a captive manner in the system carrier 6, and serve to be screwed to the mounting plate 2, which is likewise not illustrated. An additional fixing of the door operator 1, of the reception element 14 and thus of the supply unit on the non-illustrated mounting plate 2 is thereby created.

The reception element 14 preferably has recesses 63 for by-passing the non-illustrated pilot pins 23 when being placed on the likewise non-illustrated mounting plate 2, which pins are to be received in the pilot pin receptions 24. Instead of the recesses 63, through-openings may be configured, through which the pilot pins 23 can pass.

Figure 5:
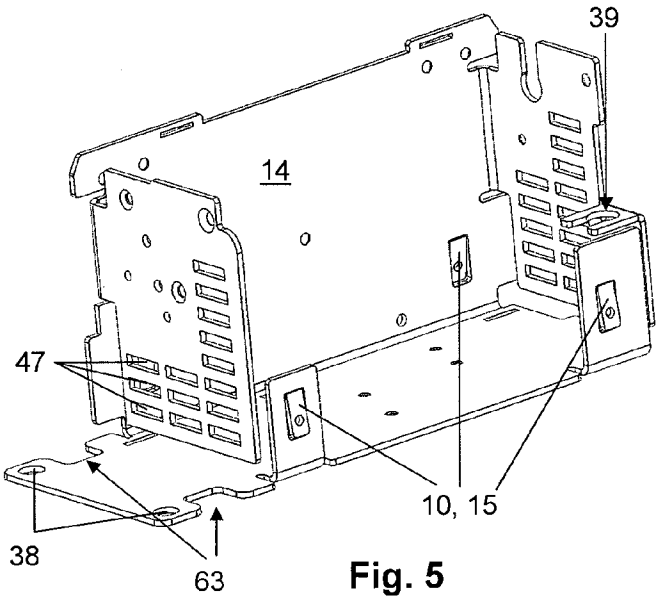
FIG. 5 is a perspective view of the reception element for receiving the supply unit.

In an enlarged perspective view, FIG. 5 shows the reception element 14 provided with the latching elements 10 in the shape of latching noses 15, wherein the reception element 14 is preferably configured as a sheet metal component and the latching noses 15, made by stamping or notching, protrude tongue-like and slanted from the plane of the sheet metal.

The reception element 14 may be screwed to the mounting plate 2 via screw passages 38.

The reception element 14, made from a stamped-bended component, is configured as a basket or as a shell, wherein furthermore a passage 39 is provided through which the connecting cable 55 can be passed, which is not illustrated in FIG. 5, for supplying power to the supply unit 8, received within the inner compartment of the reception element 14. In addition the reception element 14 has several cooling slots 47 in the sheet metal body, in order to allow for a convection cooling of the supply unit, and preferably towards the front sides thereof.

A long side of the reception element 14, in FIGS. 4 and 5 pointing slanted to the right and to the front, and/or a top side of the reception element 14 is/are preferably completely open. The reception element 14 offers thereby more room for possible electrical components, such as capacitors, etc. respectively for cooling purposes. The advantages resulting therefrom consist in that the exterior dimensions of the supply unit 8, including the reception element 14, can be smaller, because a lateral wall is omitted, or the electrical components can be dimensioned larger and/or have more distance towards each other, such that the supply unit 8 can generate more power and/or generated heat can be removed more efficiently and/or less heat will build-up in the supply unit 8.

The system carrier 6 comprises, as shown in FIG. 4, at the side adjacent to this open long side, preferably a wall with a ventilation structure, preferably in the shape of an air grate 43. By way of example, the air grate 43 is configured with ventilation slots.

Preferably, the reception element 14 is completely made from metal. At the respective provided sides (walls), the reception element 14 provides an electrical or electromagnetic screening to the outside.

Preferably, the mounting plate 2 is configured to be electrical conducting, i.e. for example likewise completely made from metal. It is furthermore preferred the mounting plate 2 has a grounding connection, for example in the shape of a clamp screw assembly, at which, in the installed condition, a grounding or neutral conductor of a usual three-wire 230 V voltage supply line for example is connected, or it is electrically coupled to the ground connection.

In case of the metallic execution, the reception element 14 itself, attached to the mounting plate 2, is thereby electrically grounded in a very simple manner, which enhances the safety of the door operator and contributes to realize the grounding of relevant parts of the door operator 1 in a very simple way.

Figure 6:
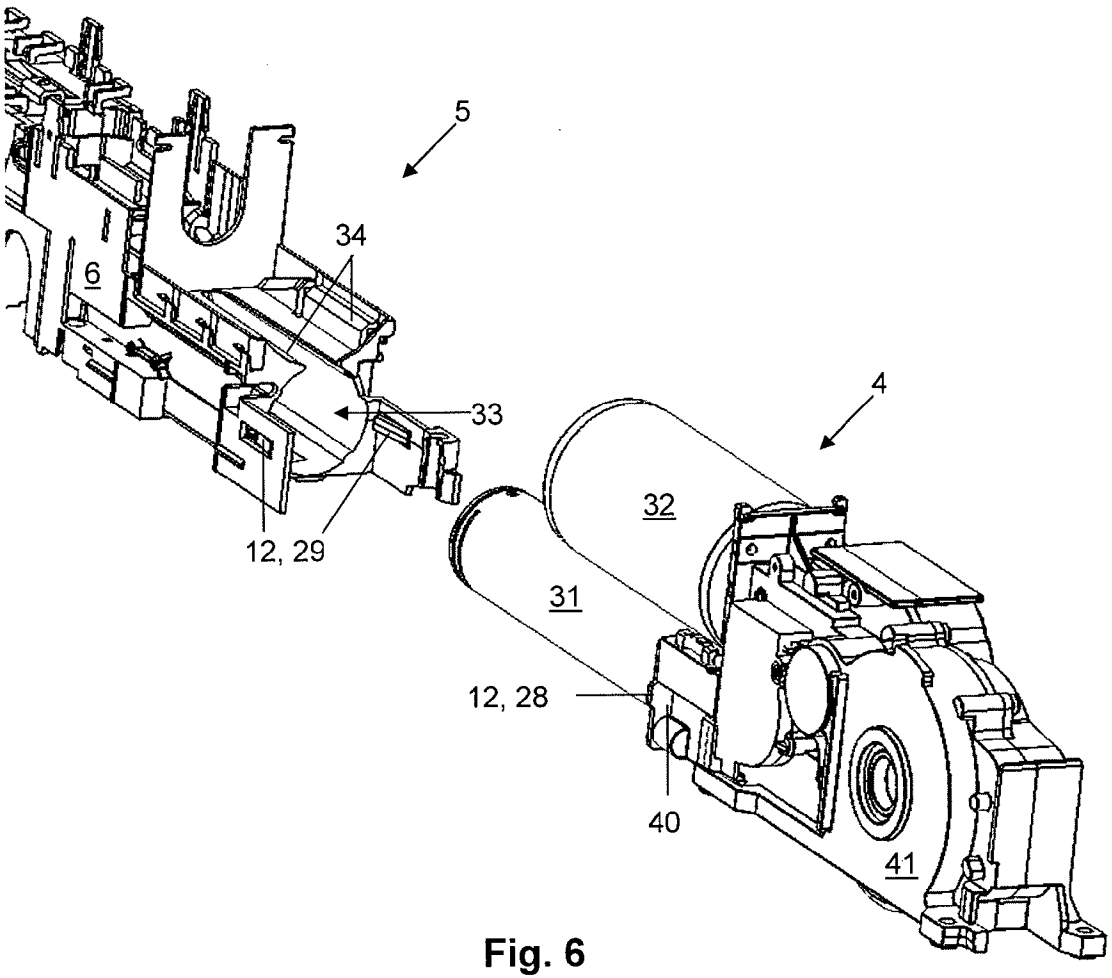
FIG. 6 is a perspective view of the joining connection between the drive module and the main module.

FIG. 6 is a perspective view of a drive module 4 and of the main module 5. In this case again, latching is accomplished between the drive module 4 and the main module 5, respectively the system carrier 6, preferably by latching elements 12, which are formed as latching projections 28 at preferably two sides of the drive module 4 facing away from each other, which can latch onto latching tongues 29, fitted at the main module 5. The drive module 4 has a spring force accumulator 31. Preferably the spring force accumulator 31 is mounted to the housing of a gear 41 of the drive module 4 via an intermediate plate 40. The latching projections 28 of the drive module 4 are advantageously configured as plate-shaped formings on the intermediate plate 40. Furthermore, the drive module 4 comprises a motor 32, wherein the spring force accumulator 31 can be introduced into a reception tunnel 33 and the motor 32 into a reception bed 34 at the main module 5. In this case, a dimensional tolerance can be adjusted between the spring force accumulator 31 and the reception tunnel 33, respectively between the motor 32 and the reception bed 34, such that a clamping action is generated between the drive module 4 and the main module 5. This increases the stability of the joining connection between the modules 4 and 5, such that the latching elements 12 are additionally relieved.

Figure 7:
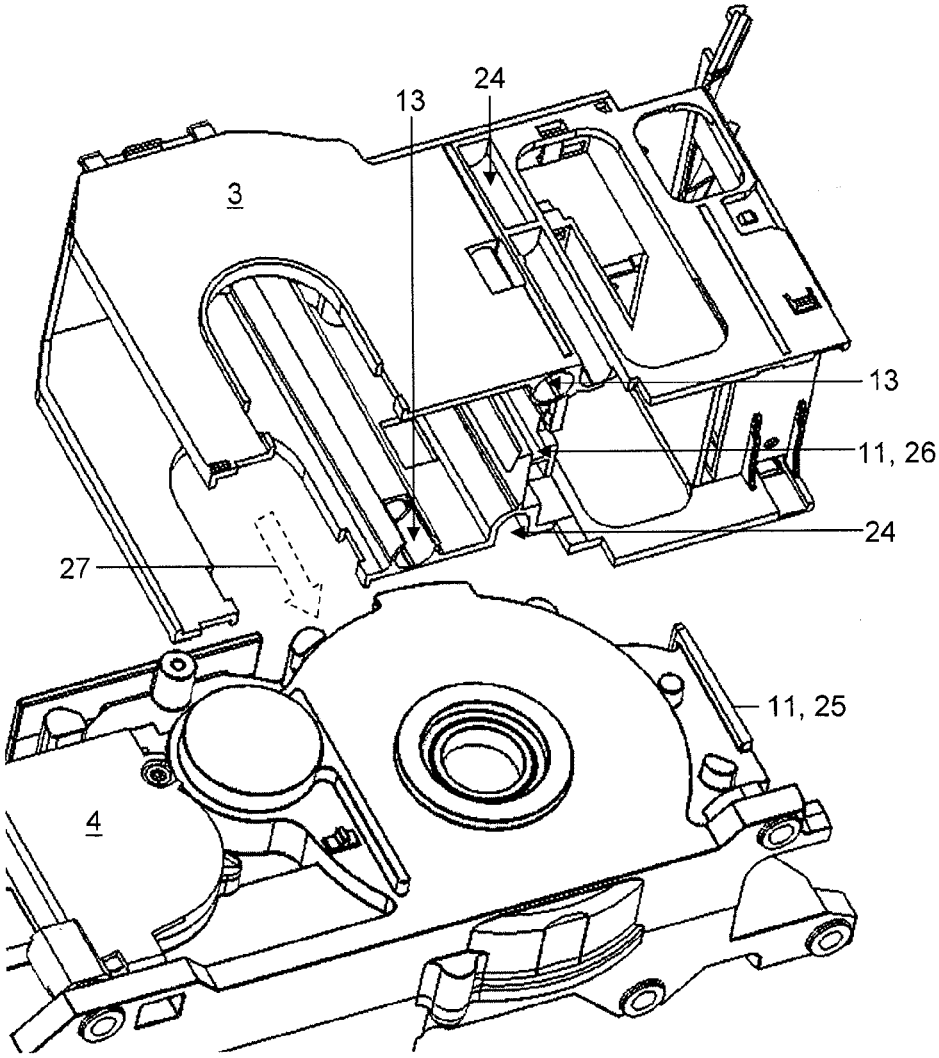
FIG. 7 is a perspective view of the joining connection between the connector module and the drive module.

FIG. 7 is a perspective view of the connection between a connector module 3 and the drive module 4. The connection comprises guides 11, which are configured as slip-on recesses 26 at the side of the connector module 3 and conformed or configured as slip-on projections 25 by way of example at the drive module 4. The slip-on projections 25 can be introduced into the slip-on recess 26 like a tongue-groove joint. The joining 27 is realized from a direction essentially vertical to the extension plane of the mounting plate 2, not illustrated for better visibility, which is located below the drive module 4.

Furthermore, analogously to the system carrier 6, screw receptions 13 are preferably also configured within the connector module 3, such that, when screwing the drive module 4 to the mounting plate 2, the drive module 4 as well is not releasable from the latter any more. The connector module 3 in turn is preferably only retained at the drive module 4, while at least partially enveloping it.

It is furthermore preferred the connector module 3 comprises likewise pilot pin receptions 24 for a preferably latching reception of associated pilot pins 23, likewise not illustrated.

Figure 8B:
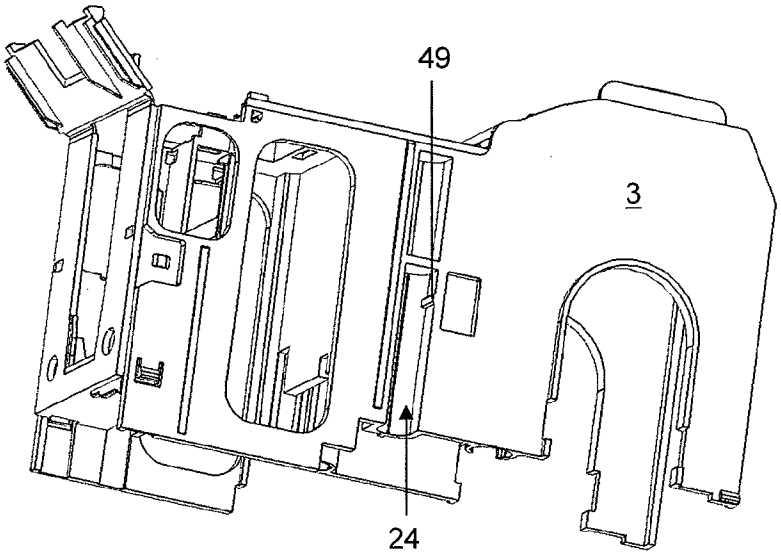
FIGS. 8*a* and 8*b* are the connector module of FIG. 7 in two perspective views.
Figure 8A:
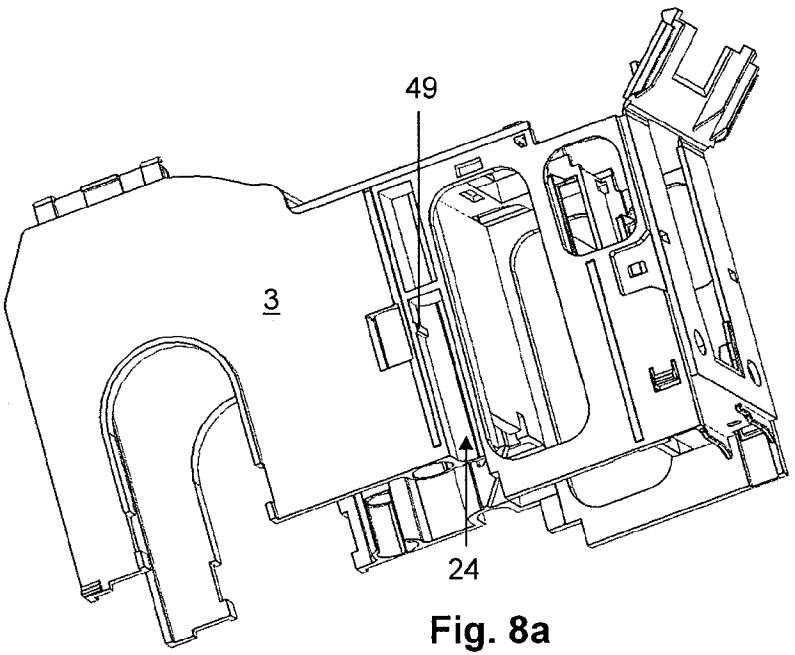

FIG. 8*a* shows the connector module 3 of FIG. 7 in a similar perspective, wherein a right front side is visible. FIG. 8*b* shows the connector module 3 from a side opposite to FIG. 8*a*, again with the visible front side of FIG. 8*a*. The pilot pin receptions 24 are particularly well visible in these two Figures. The latching onto the corresponding, non-illustrated pilot pins 23, is realized for example by latching projections 49, which, in the shown example, are conformed to the connector module 3 and are preferably rigid and configured in the pilot pin receptions 24.

Figure 9A:
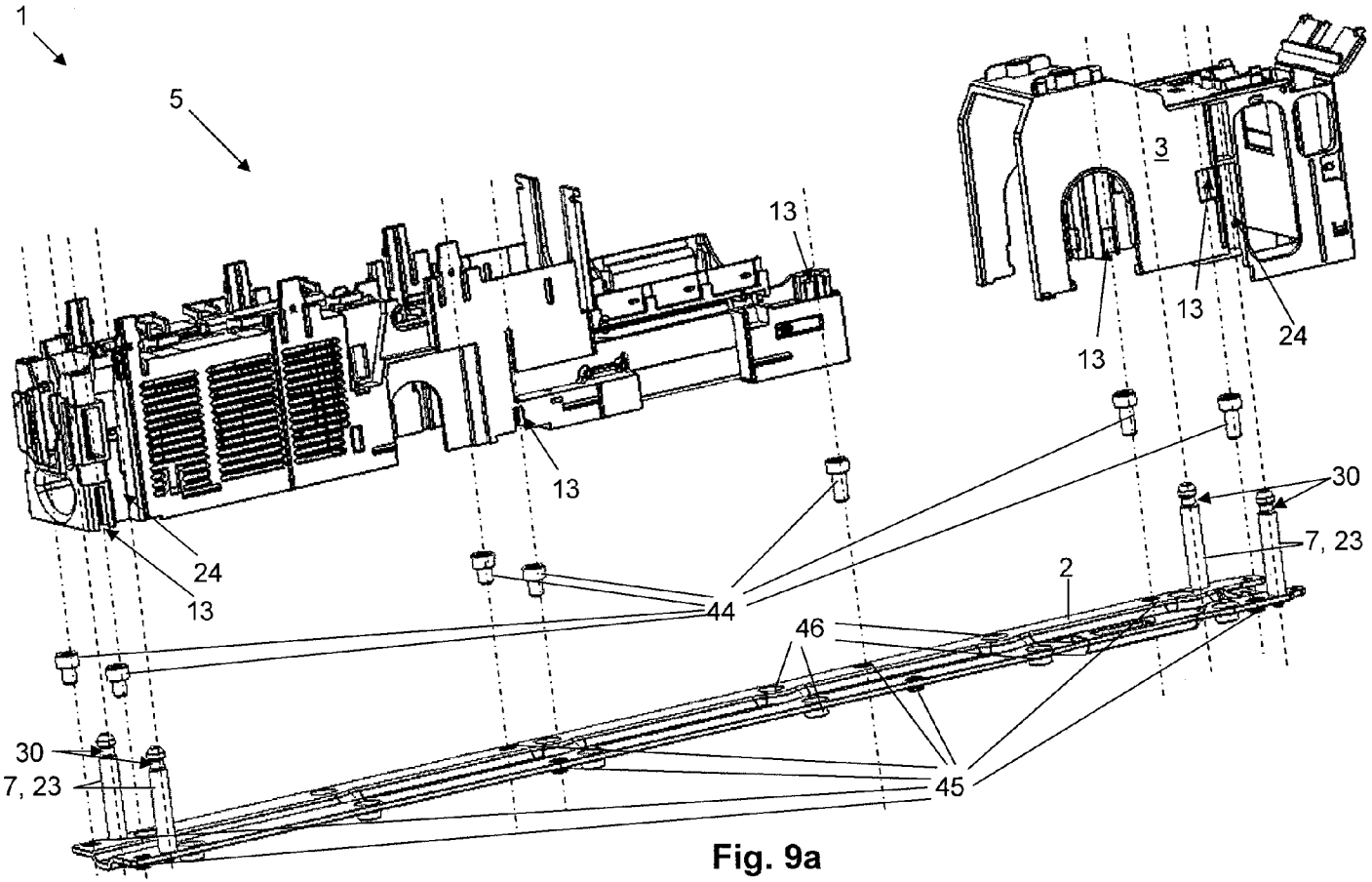
FIG. 9*a* is a perspective exploded view of the disposition of the connector module and the main module on the mounting plate.

In a perspective exploded view, FIG. 9*a* illustrates the disposition of the connector module 3 and the main module 5 above the mounting plate 2. By way of example four latching elements 7 are disposed on, respectively at the mounting plate 2, which are configured as cylindrically shaped pilot pins 23 and preferably extend vertically with respect to a plane of the mounting plate 2. The pilot pins 23 preferably have latching recesses 30. The latching recesses 30 are milled into the cylindrically shaped pilot pins 23 as a surrounding groove and can latch in latching hooks or projections or other latching devices, which are fitted within the pilot pin receptions 24 at the connector module 3, respectively in the system carrier 6 of the main module 5. The dashed lines are intended to illustrate in which pilot pin reception 24 of which module 3, 5 the respective pilot pin 23 is received.

Furthermore, screw elements in the shape of attachment screws 44 are shown with preferably round screw heads in cross-section. The dot-dashed lines are intended to illustrate in which screw reception 13 of which module 3, 5 the respective attachment screw 44 is received in a captive manner and in which screw threaded hole 45, i.e. in which circular hole with female thread, of the mounting plate 2 the respective attachment screw 44 is screwed, in order to finally attach the entire door operator 1 at the mounting plate 2.

The remaining, exemplary twelve through-openings of the mounting plate 2, four of them being provided with a reference numeral 46 by way of example, represent attachment openings 46, by which additional non-illustrated attachment screws accomplish the mounting of mounting plate 2 to the aforementioned reception body. The attachment openings 46 are preferably configured by bushing sections, which protrude from the mounting plate 2 in the direction of the reception body, namely at the side of the mounting plate 2 facing away from the modules 3, 4, 5. Thus the bushing sections simultaneously form the base, respectively the feet on which the mounting plate is supported and bears against the reception body. The attachment openings 46 are configured preferably as a countersunk hole at the side facing the system carrier 6, such that countersunk screws can be used as attachment screws.

Figure 9B:
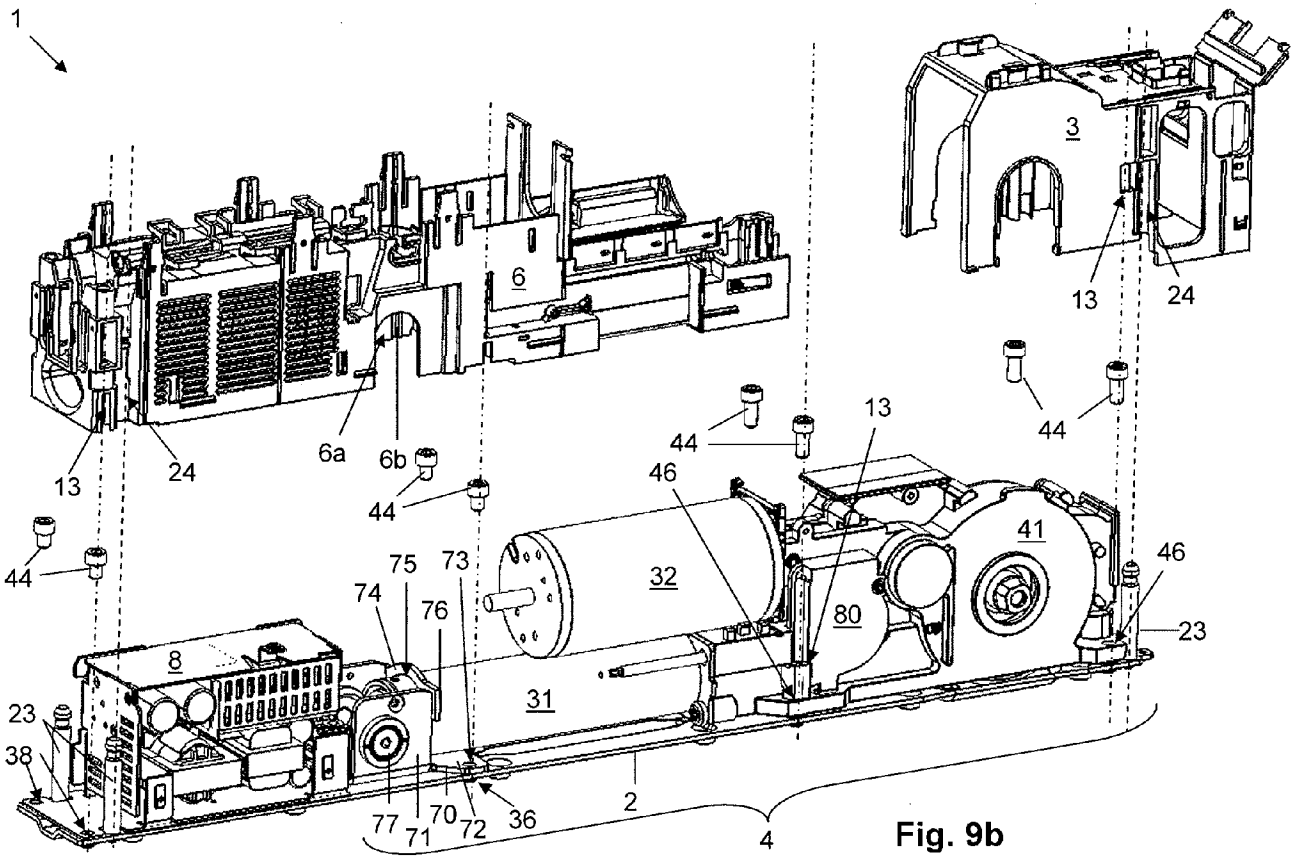
FIG. 9*b* is a view according to FIG. 9*a*, completed with the drive module and the supply unit.
Figure 9C:
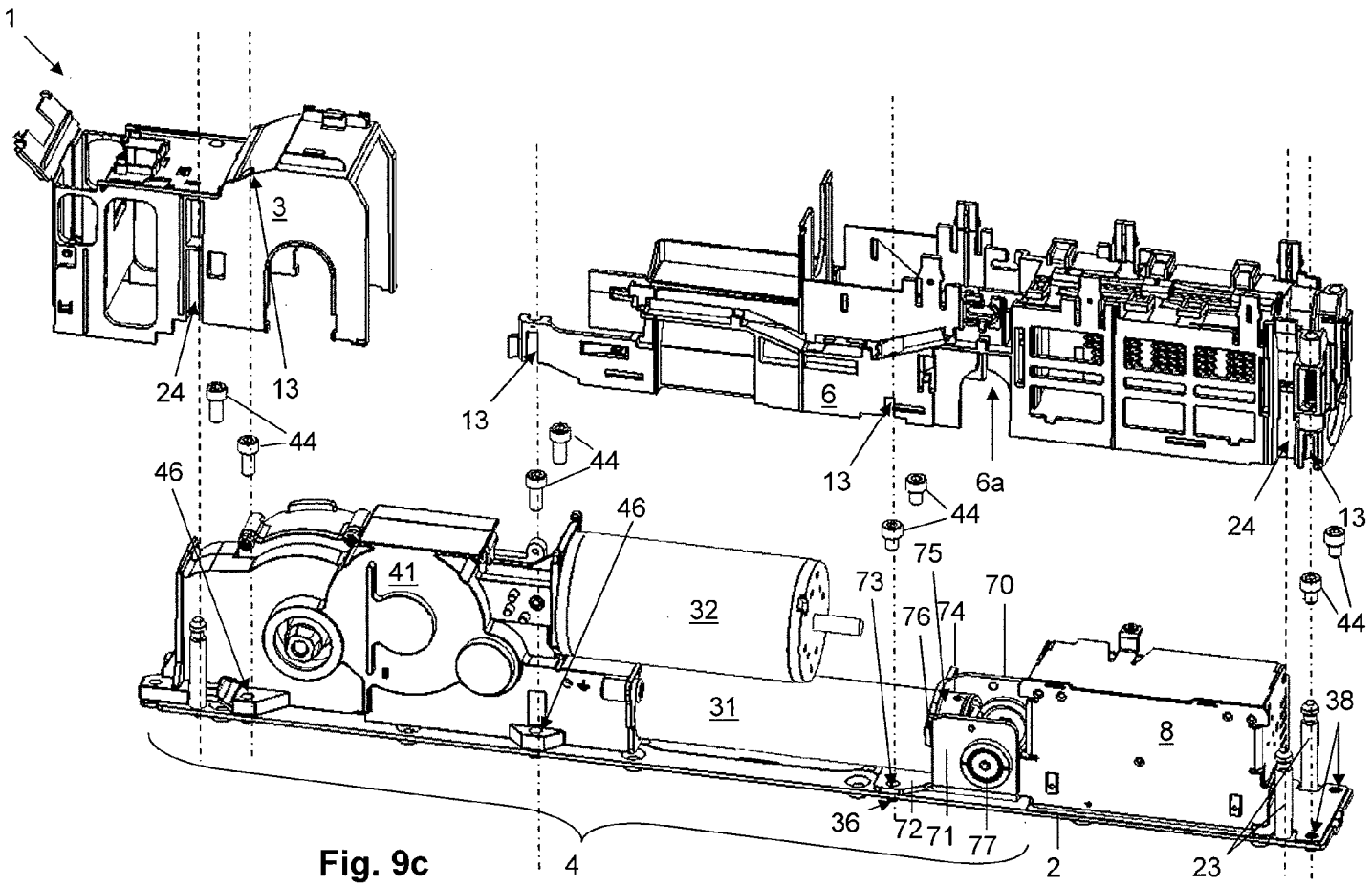
FIG. 9*c* is a view of FIG. 9*b* from a different, essentially opposite angle of view.

FIG. 9*b* is the door operator 1 with the supply unit 8 and the drive module 4 added. For the purpose of the description, the supply unit 8 and the drive module 4 are shown as placed on the mounting plate 2. However, this does not represent the mounting sequence. The dashed, respectively dot-dashed lines are only represented in FIG. 9*a* for the respective front pilot pins 23, respectively the attachment screws 44. FIG. 9*c* in turn shows the door operator 1 of FIG. 9*b* from an opposite side with regard to FIG. 9*b*.

With an end facing away from the gear 41, as can be seen, the spring force accumulator 31 of the drive module 4 leads into a device 70 for adjusting, respectively for changing the closer spring pre-tension of the spring force accumulator 31.

The pre-tension adjusting device 70 has preferably a U-shaped mounting bracket 71 which is open to the top.

Preferably the mounting bracket 71 comprises a first affixing section 72 and a second affixing section 74.

In the installed condition, the first affixing section 72, preferably in the shape of a projection, extends essentially parallel to a side of the mounting plate 2 facing the mounting bracket 71. The first affixing section 72 has attachment openings 73, which are configured such as to be aligned with associated attachment openings 36 of the mounting plate 2 in the installed condition, and thus serve for attaching the mounting bracket 71 at the mounting plate 2.

The second affixing section 74 essentially consists of a preferably plate-shaped member 74, which is mounted or conformed to the mounting bracket 71. The plate-shaped member 74 extends essentially transversely to a longitudinal extension of the spring force accumulator 31 and has a through-opening 75 which extends in longitudinal extension of the spring force accumulator 31 and serves for passing through a spring tube, not indicated in detail, of the spring force accumulator 31. Slide-in projections 76 are configured at lateral, i.e. vertical with regard to the mounting plate 2, free terminal sections of the plate-shaped member 74, and they extend in a transverse direction with regard to the longitudinal extension of the spring force accumulator 31. As an alternative, the slide-in projections 76 are formed by the terminal sections themselves.

Adjusters 77 are freely rotatably received in preferably both branches of the U-shaped mounting bracket 71. Each adjuster 77 comprises a freely rotatable and preferably supported axis in the associated branch of the mounting bracket 71.

On each axis, at an end facing towards an exterior side of the mounting bracket 71, respectively one adjusting wheel is torque-proof-disposed or integrally configured, for example in the shape of a circular disc with a screw section, such as a hexagon socket or the like. A gear member, preferably in the shape of a bevel gear or crown wheel, is torque-proof disposed at the opposite end of the respective axis, facing the inner compartment of the mounting bracket 71.

At its end, facing away from the drive module 4, the spring force accumulator 31 likewise presents a device for adjusting the closer spring pre-tension. At its end, facing away from drive module 4, this adjusting device comprises a gear member, which is torque-proof disposed on a shaft or integrally configured with the shaft, which in turn is received stationarily in longitudinal extension of the spring force accumulator 31 and nevertheless freely rotatably within the spring force accumulator 31. At least in the inner compartment of the spring force accumulator 31, the shaft has a male thread section on which a bushing with female thread is screwed, which is thus brought into operative engagement. Simultaneously, the bushing forms an abutment for the not visible closer spring of the spring force accumulator. Rotating the shaft thus effects a translationally movement of the bushing in longitudinal direction of the spring force accumulator and thus modifies the closer spring pre-tension.

The system carrier 6 has slide-in recesses, for example in the shape of U-shaped grooves 6*b* and configured as corresponding to the slide-in projections 76, only one of them being visible in FIG. 9*b*. Furthermore, the system carrier 6 has lateral recesses 6*a*, at least for passing through the aforementioned adjusting wheels. If the recesses and adjusting wheels are twofold, i.e. configured at opposite sides of the door operator 1, one adjusting wheel is accessible from the outside at all times, even if the door operator 1 is installed close to a ceiling.

When mounting the drive module 4, at first the pre-tension adjusting device 70 is pushed into the recess 6*a*, in that the slide-in projections 76 are inserted or slid into the grooves 6*b*. The grooves 6*b* are preferably configured such that the mounting bracket 71 reaches a clamping engagement with the grooves 6*b* when being pushed into the recess 6*a*. As an alternative or in addition, latching elements may be provided for fixing the mounting bracket 71 in the system carrier 6.

Thereupon, the drive module 4, as described in conjunction with FIG. 6, is pushed into the system carrier 6 and thus the spring force accumulator 31 is pushed through the through-opening 74 of the mounting bracket 71. In the final installed condition, the gear member of the spring force accumulator 31 reaches rotational engagement with the one or more gear member(s) of the device 70.

The power supply unit 8, such as described in conjunction with FIG. 1, is pushed into the system carrier 6 from below and latched onto it.

The connector module 3, such as described in conjunction with FIG. 7, is placed onto the drive module 4 from above. Preferably an incremental encoder 80, which by way of example likewise has a screw reception 13, in which the associated attachment screw 44 is captively received, is placed onto the housing of the drive module 4.

The thus formed self-carrying unit can now be placed onto the pilot pins 23 of the mounting plate 2 and latched in the latching recesses thereof by its pilot pin receptions 24 by way of example only at the system carrier and the connector module 3. The mounting plate 2 has been previously installed at the desired reception body.

By way of example only the power supply unit 8, the mounting bracket 71 and the gear 41, which are configured dimensionally very stable, are now screwed to the mounting plate 2 by the attachment screws 44, which are captively received in associated screw receptions 24 of the system carrier 6, the incremental encoder 80 (FIG. 9*b*) and of the connector module 3, and which pass through the attachment openings 38, 73, respectively 46. This means, the system carrier 6, the incremental encoder 80, namely the housing thereof, and the connector module 3, which respectively are made from plastic material, are preferably not screwed to the mounting plate 2. They are kept in place just on account of the latching effect via the pilot pins 23 and their own attachment at the power supply unit 8, mounting bracket 71, respectively gear 41.

For stability, and electromagnetic reasons, the power supply unit 8, the mounting bracket 71 and the housing of the gear 41 are preferably made from metal. The attachment at the preferably metallic mounting plate 2 simultaneously provides grounding of these components, without requiring any additional measures.

Figure 10A:
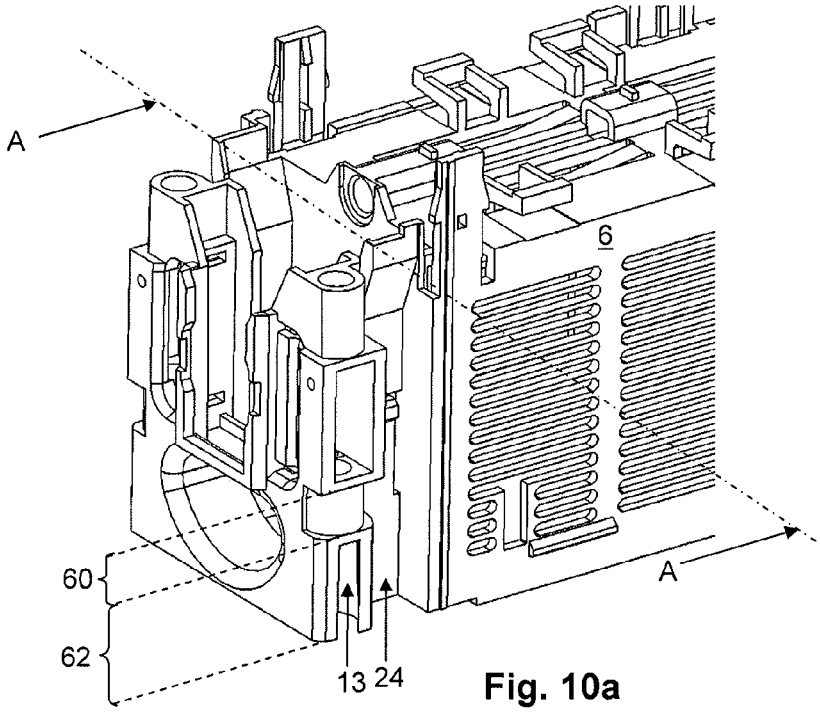
FIG. 10*a* is a perspective view of the system carrier in a section.

FIG. 10*a* is a section of the system carrier 6 in a perspective view from the distant front side of the connector module 3. By way of example in particular a pilot pin reception 24 and a screw reception 13 are shown in this Figure.

The screw reception 13 has preferably an intermediate section 60, which is hollow on the inside for passing-through a screw driver for example, from the top of the system carrier 6. The intermediate section 60, for example in the shape of a bushing or an inner ring, has internal dimensions, which are smaller than the corresponding dimensions of the screw head of the respective attachment screw 44. It is thereby possible to insert the respective attachment screw 44 from the bottom, i.e. from the direction of the mounting plate 2 to be mounted later. The intermediate section 60 delimits the slide-in distance for the attachment screw 44.

In the direction of the non-illustrated mounting plate 2, the intermediate section 60 is adjoined by the proper reception section 62, in which the associated non-illustrated attachment screw 44 is received, preferably in a clamped manner. For this purpose, the reception section 62 has preferably a through-opening with a circular cross-section, such that the associated attachment screw 44 can be rotated in this reception 62, i.e. screwed to the likewise non-illustrated mounting plate 2 by a screw driver or the like.

Figure 10B:
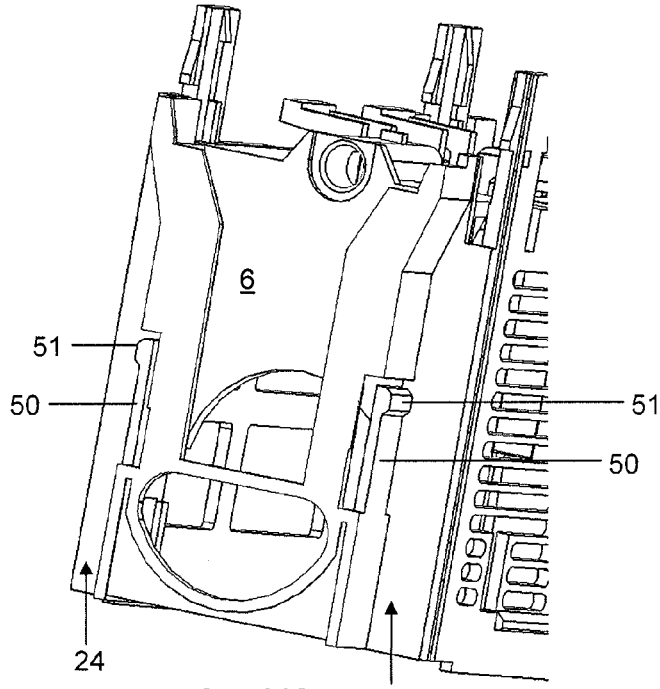
FIG. 10*b* is a sectional view of the system carrier along a line A-A in FIG. 10*a;*

FIG. 10*b* is the system carrier 6 according to FIG. 10*a* in a section along the line A-A in FIG. 10*a*. In this sectional view, it can be seen that latching tongues 50 are configured in the two now exposed pilot pin receptions 24 for latching the respective associated non-illustrated pilot pin 23. In the example shown, the latching tongues 50 are resiliently disposed and are configured, preferably cut out, at a side of the pilot pin reception 24, located on the inside with regard to the associated pilot pin 23. Preferably at its free end, each latching tongue 50 has a latching projection 51 which points in the direction of the inner compartment of the respective pilot pin reception 24 and, in the installed condition, engages in the latching recess 30 of the associated pilot pin 23 and thus pre-immobilizes in this case the system carrier 6 at the mounting plate 2. The resilient configuration of the latching tongue allows for easy placing the system carrier 6, respectively the entire door operator 1 onto the pilot pins 23, respectively for removing them therefrom.

Figure 10C:
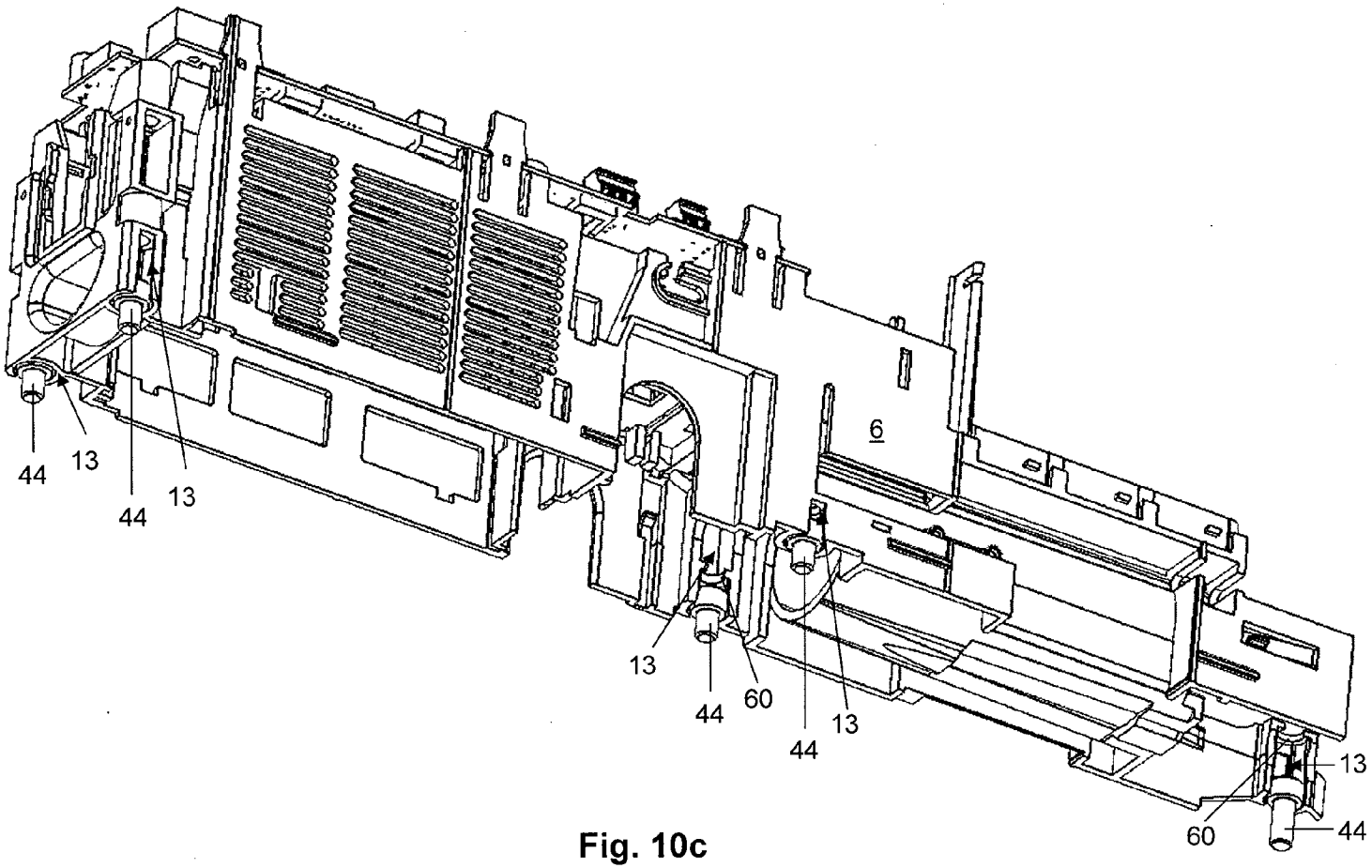
FIG. 10*c* is the system carrier with inserted attachment screws.

FIG. 10*c* shows the disposition of the attachment screws 44, by way of example at the system carrier 6, in the screw receptions 13 thereof in a screw-in position with regard to the non-illustrated mounting plate 2. This way the intermediate sections 60, configured in the screw receptions 13, are visible as a bushing section or as an inner ring section.

Figure 10D:
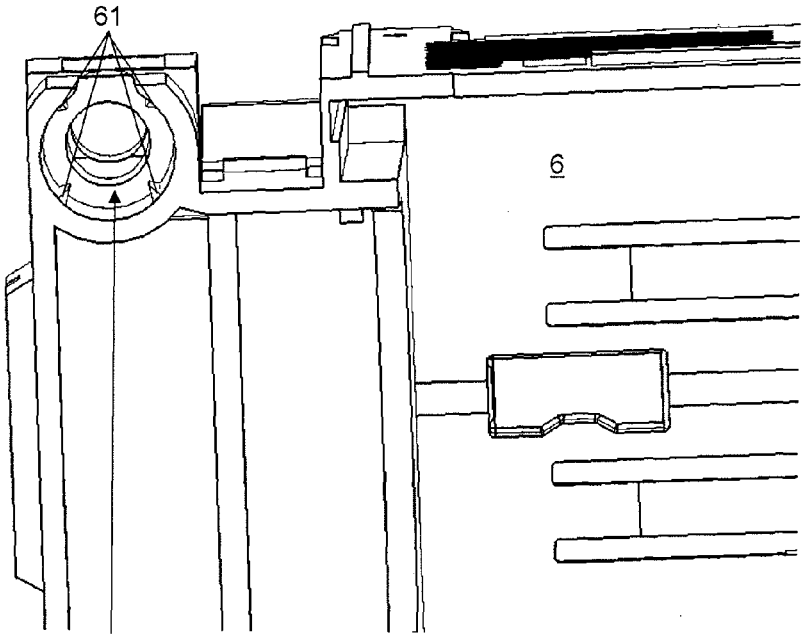
FIG. 10*d* is the left front corner area of the system carrier of FIG. 10*a* in a view from below.
Figure 10E:
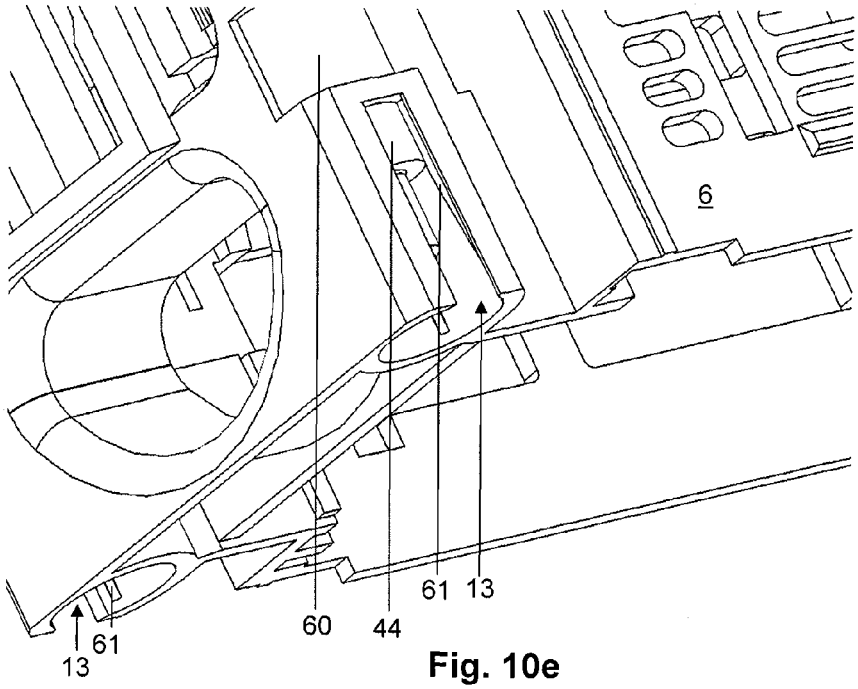
FIG. 10*e* is the left front corner area of the system carrier of FIG. 10*a* in a view from below and with inserted attachment screw.

FIG. 10*d* and FIG. 10*e* show an enlarged detail of the left frontal corner area of the system carrier 6 of FIG. 10*a*. By way of example, the screw reception 13 has four clamping projections 61 at its inner side, serving to receive the associated attachment screw 44 in a captive manner, which is illustrated in FIG. 10*e*. Each clamping projection 61 essentially protrudes from an inner walling of the screw reception 13 in the direction of the central axis of the screw reception 13 and forms a type of rib 61. Each rib 61 is preferably configured such that, in a first area, facing the intermediate section 60, it presents an almost constant height with regard to the inner walling of the screw reception 13. In a second area, adjoining the first area, the height of the respective rib 61 is reduced in the direction of the non-illustrated mounting plate 2. The distance of the ribs 61 towards each other increases in this direction such that introducing the attachment screw 44, respectively the head thereof, into the screw reception 13 is made easier. Moreover, screwing-in the attachment screw 44 becomes gradually easier, because the screw head moves in the direction of the mounting plate 2. When screwing it out, the attachment screw 44 is automatically and gradually clamped again in the screw reception 13, because the door operator 1 continues to be held by the pilot pins 23.

The above described screw receptions 13 are also configured in this or in a similar way at the housing of the incremental encoder 8 and at the connector module 3.

Figure 11A:
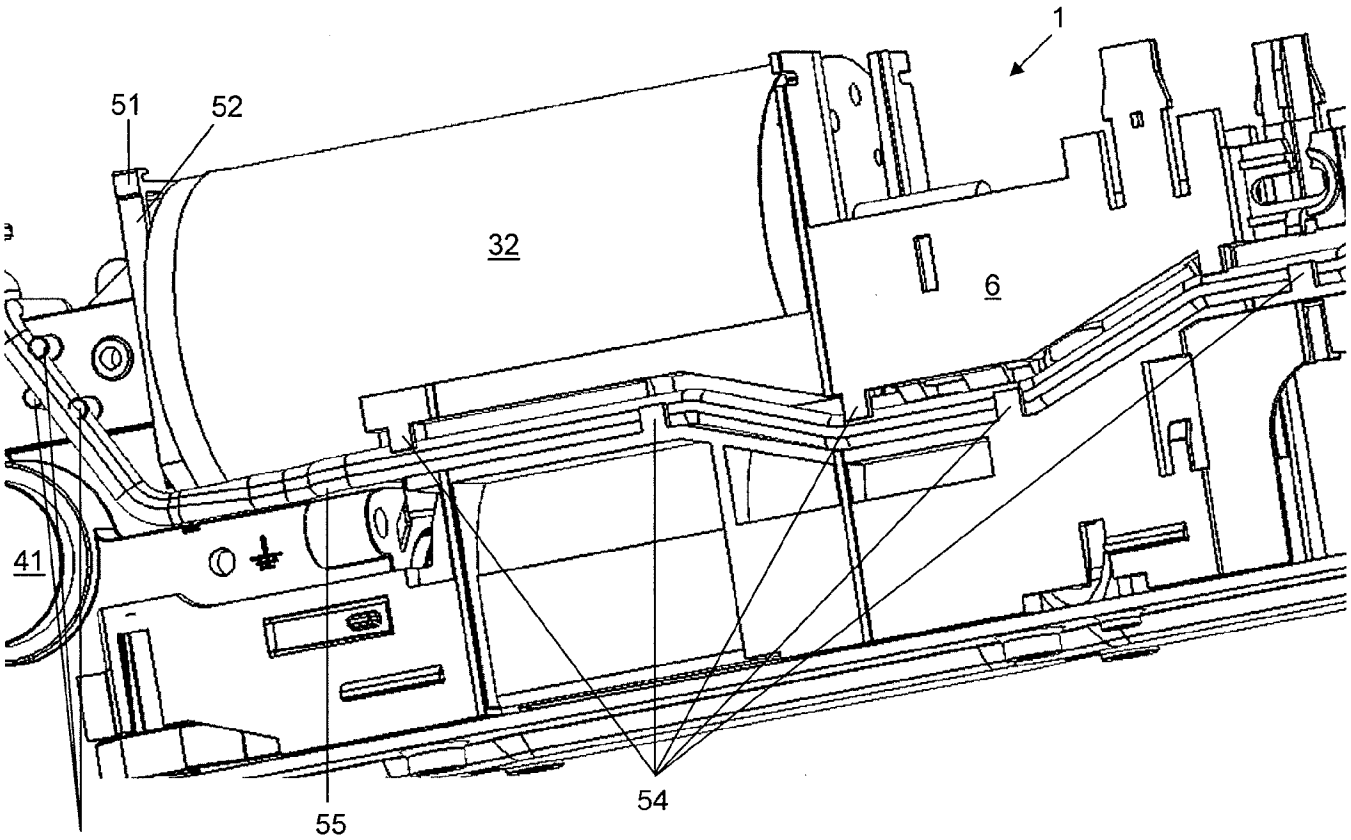
FIG. 11*a* is a perspective partial, lateral view of the door operator.

FIG. 11*a* is a section of a lateral view of the door operator 1, wherein some of the components, such as power supply unit 8, control unit 9 and spring force accumulator 31, received at or in the system carrier 6, have been omitted for the sake of clarity. As can be seen, the aforementioned voltage supply line, respectively the voltage supply cable 55, coming from the gear 41, is run first past the motor 32 and then along the system carrier 6 in the direction of the non-illustrated power supply unit 8, i.e. stationarily fixed and preferably guided, advantageously both at the gear 41 and the system carrier 6.

The motor 32 is preferably stationarily mounted to the gear 41, i.e. to the housing thereof, via a motor flange 52. In the area of the motor flange 52, the housing of the gear 41, not identified in detail, has projections 53 at least at one side, between which the voltage supply line 55 is run, preferably in a clamped manner, and is thus fixed.

The system carrier 6 in turn has clamping respectively latching elements preferably in the shape of projections 54, behind which the voltage supply line, respectively the voltage supply cable 55 is preferably clamped in the direction of the non-illustrated power supply unit 8, i.e. installed in a fixed manner. The projections 54 extend from the system carrier 6 preferably parallel to the long side of the system carrier 6, pointing to the front in FIG. 11*a*. The voltage supply line 55, run behind the projections 54, is thereby mechanically protected towards the outside in the area of the projections 54.

Figure 11B:
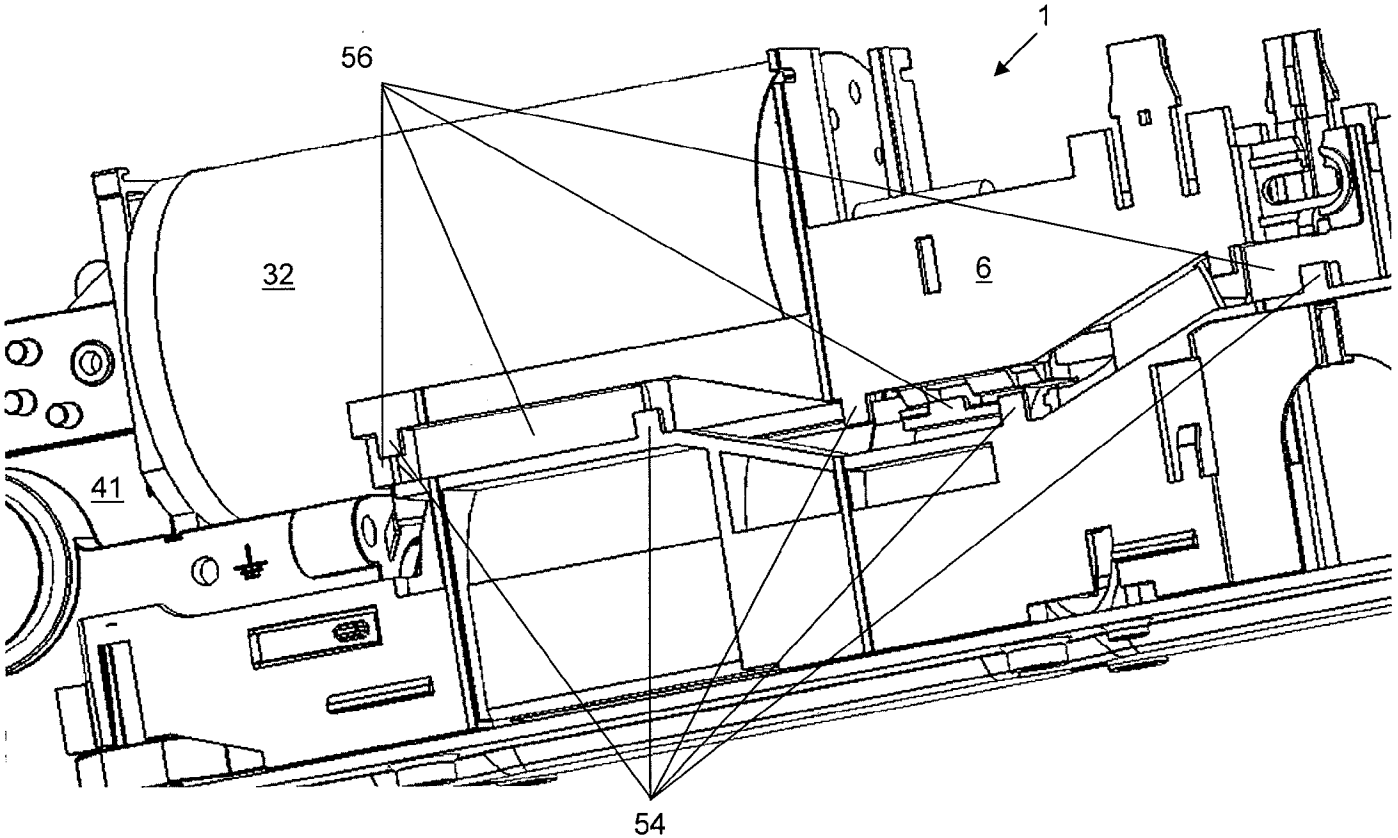
FIG. 11*b* is a view of FIG. 11*a*, without voltage supply line

As can be seen in FIG. 11*b*, the voltage supply line 55 is not shown. The projections 54 correspond to stabilizing, respectively support sections 56, which in FIG. 11*b* are disposed behind the projections, namely disposed or configured in the inner compartment of the system carrier 6. The voltage supply line 55 comes to rest on the support sections 56, such that it should not get into critical areas of the system carrier 6, and thus no minimal risk of malfunction and/or damage is to be expected.

The projections 54 and the support sections 56 are configured such that the voltage supply line 55 can be run between and through them. The sides of the projections 54 facing the support sections 56 have preferably such a distance to the sides of the support sections 56 facing the projections 54 that the voltage supply line 55 is clamped between the projections 54 and the corresponding support sections 56. An even more secure installation of the voltage supply line 55 is thereby possible.

As an alternative, the support sections 56 are configured continuously.

Figure 12:
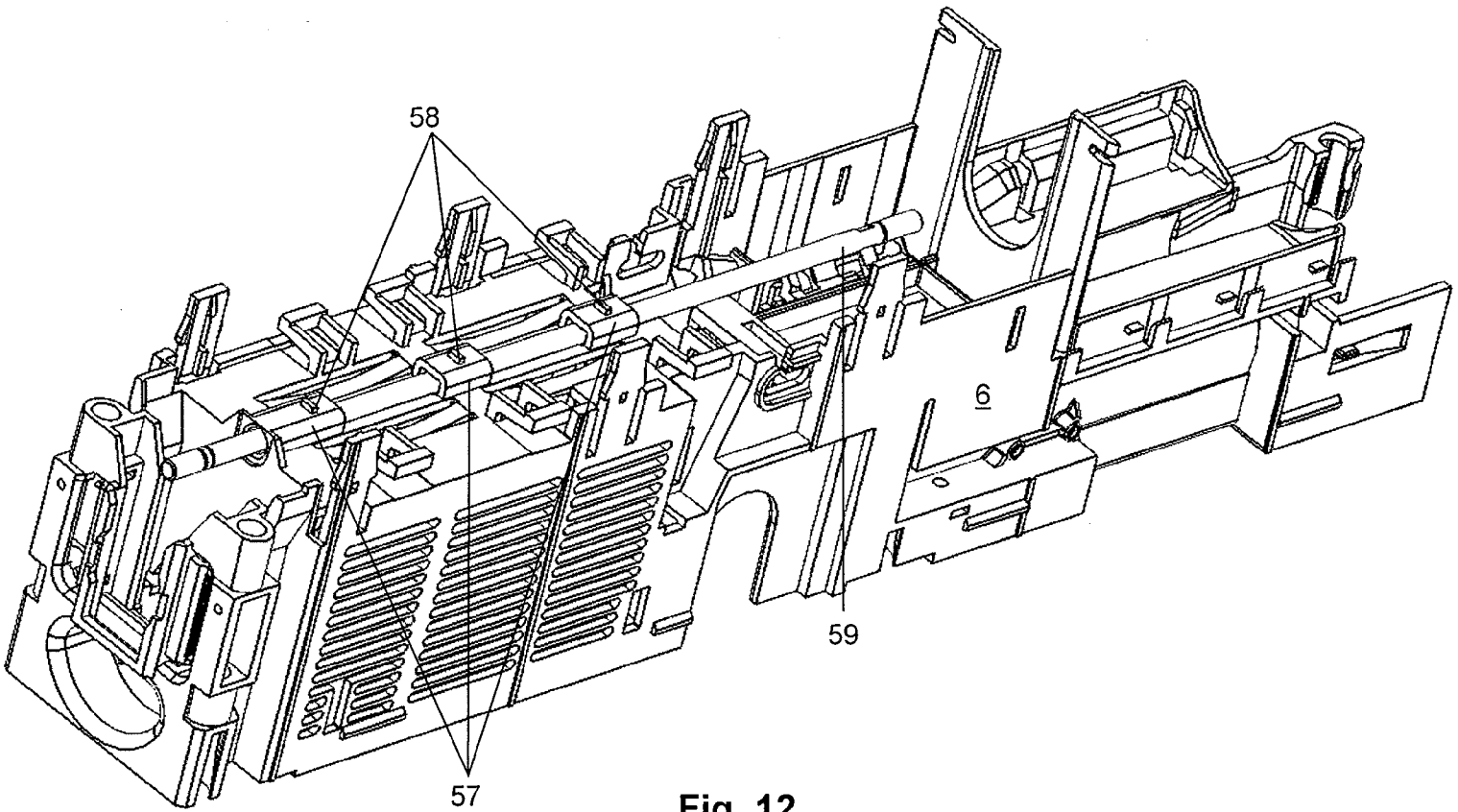
FIG. 12 is a view of the system carrier in conjunction with a rod of a closing sequence controller.

As shown in FIG. 12, the system carrier 6 has preferably furthermore guiding sections 57, which are preferably provided to receive a transmission element 59, of a closing sequence controller for example, in such a guided manner that the transmission element 59 can not get into critical areas of the system carrier 6 either, and as a consequence minimal risk of malfunction and/or damages is to be expected.

The guiding sections 57 are preferably configured as bush-type sections projecting to the top in FIG. 12, such that relatively little material is required. Furthermore, as shown in FIG. 12, the guiding sections 57 have respectively one projection 58 pointing upwards. The projections 58 serve additionally to support the non-illustrated circuit board carrier 20. Obviously, the thus configured supports may be formed by the top sides of the guiding sections 57 as well.

As an alternative, there is a single continuous guiding section 57.

The transmission element 59 may be configured as a rope control, a Bowden cable, a hydraulic line or rod for example, in the event of a mechanically operated closing sequence controller. In the event of an electrically operated closing sequence controller, the transmission element 59 may be an electrical line, respectively an electrical cable.

Instead of being utilized for the transmission element 59, the guiding sections 57 may be utilized for the passage of signalling lines of sensors, or the like.

Figure 13:
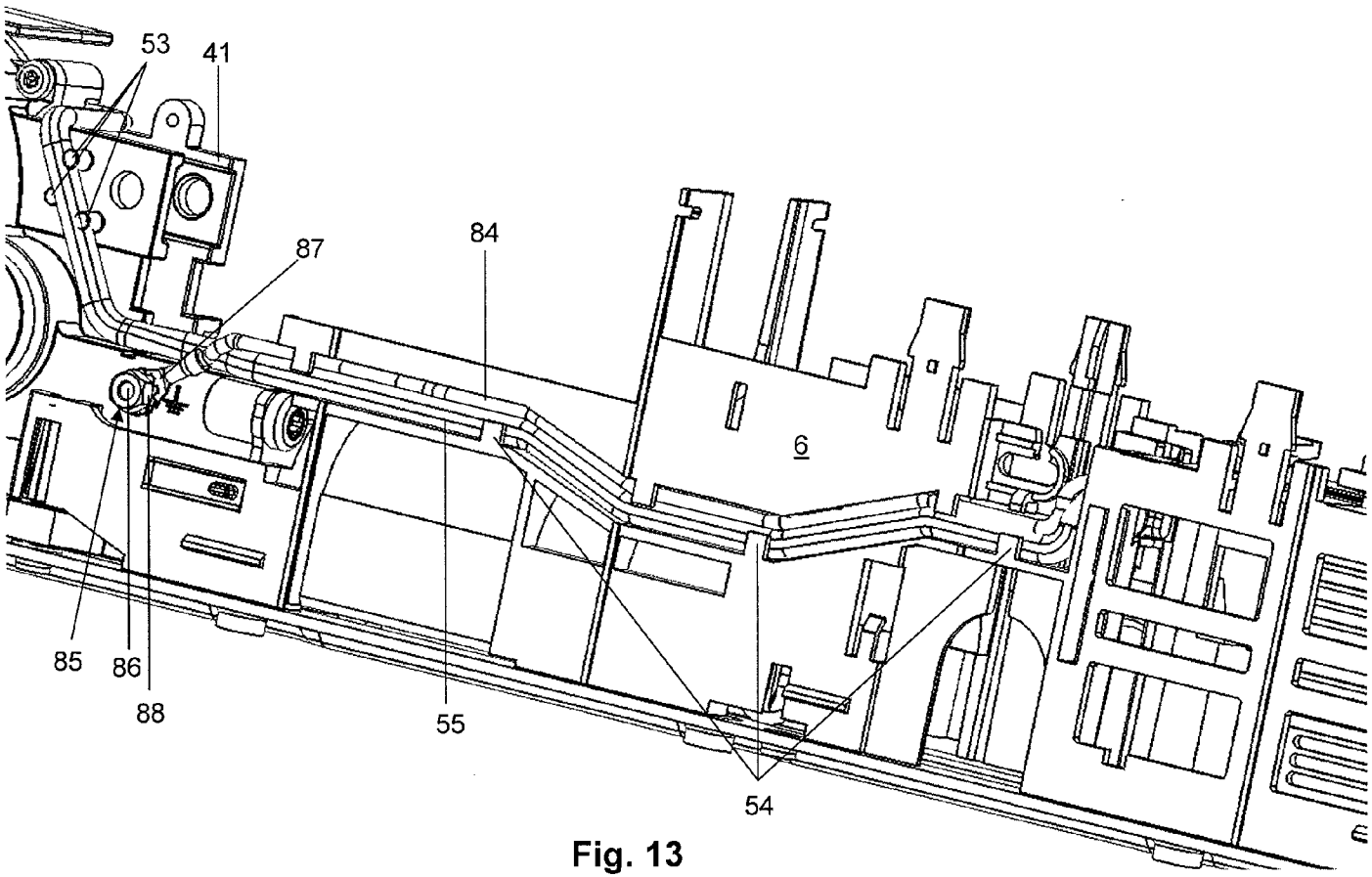
FIG. 13 is a modification of the grounding of the power supply unit of the door operator.

For clarity reasons, only the essential components of the door operator with regard to an alternative grounding of the power supply unit 8, respectively of the reception element 14, are illustrated in FIG. 13. As can be seen, in addition to the voltage supply cable 55, a grounding line 84 is preferably installed, clamped preferably between the projections 54 and the not visible support sections 56 of the system carrier 6. In the illustrated example, the grounding line 84 ends in the area of the housing of the gear 41. A ground connection 85 is preferably configured at the gear housing. The ground connection 85 comprises by way of example a metal pin 86 with a male thread protruding from the gear housing, an eyelet 87 of the grounding line 84 being slipped onto the pin and fastened by a nut 88. As an alternative, the housing has a screw-in opening with female thread into which a screw is screwed, onto which the eyelet 87, respectively the end of the grounding line 84 itself, has been previously placed or wound.

Again as an alternative, the grounding cable 84, like the voltage supply line 55, may be guided and installed as well through the projections 53 and grounded in the area of the connector module 3, not visible in FIG. 13, by being screwed to the mounting plate 2 for example.

Figure 14:
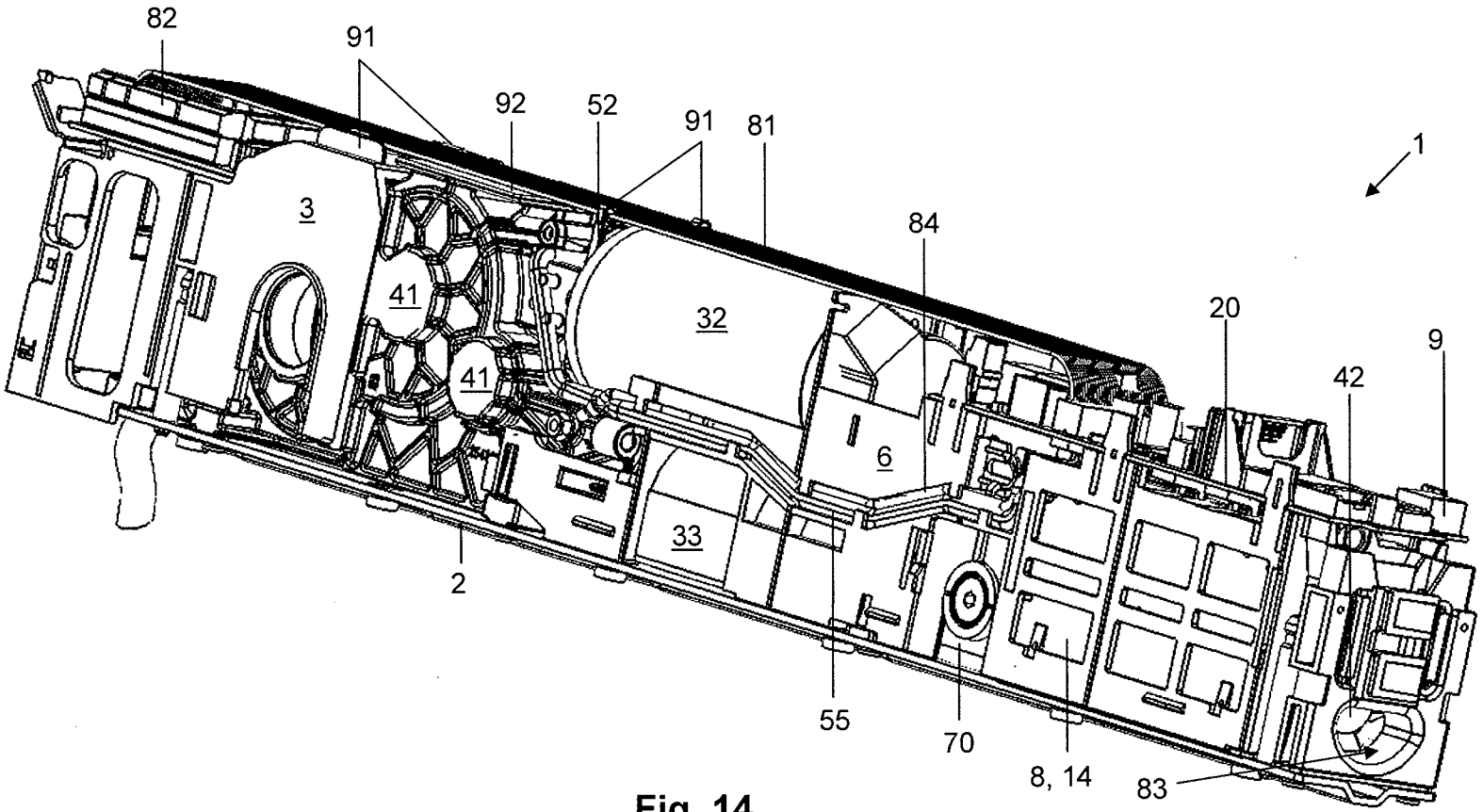
FIG. 14 is a completed door operator without enclosure and with a modified gear housing.
Figure 15:
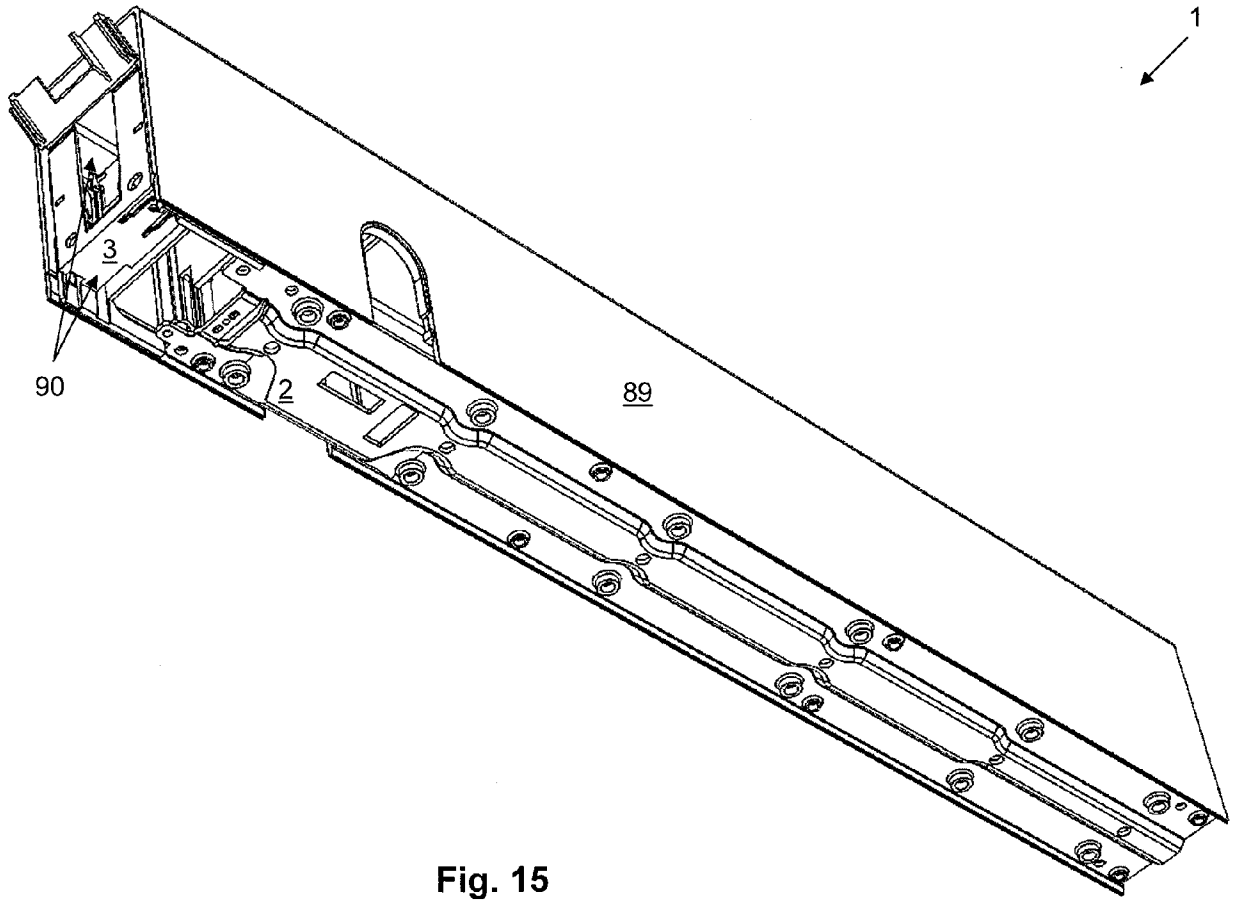
FIG. 15 is the mounting plate, connector module and enclosure profile for the door operator.

FIG. 14 shows the entire door operator 1 without enclosure, whereas FIG. 15 shows a disposition of simply the mounting plate 2, the connector module 3 and an enclosure in the shape of an enclosure profile 89.

At an end facing away from the connector module 3, the system carrier 6, in the area of the fan 42, presents preferably a through-opening or ventilation opening 83. It is through this opening 83 that the fan 42 is able to introduce cool air in the direction of the power supply unit 8, respectively the reception element 14, or to evacuate warm exhaust air from the door operator 1 in the direction of the ventilation opening 83.

The second solution has proven to be particularly advantageous, according to which the fan 42 so to speak "draws" the warm exhaust air out of the door operator 1. This is how a cooling air stream for the entire door operator 1 can be realized in conjunction with the enclosure profile 89 in a very inexpensive manner.

The connector module 3 is preferably open towards an end side area and a front side area and/or at a side in the direction of the mounting plate 2. The fan 42 is thus able to effectively draw air, coming from the connector module 3, into the door operator 1.

At a side facing away from the mounting plate 2, the connector module 3 has a predetermined distance to the enclosure profile 89. The drawn in air is thereby moved almost vertically within the connector module 3, advantageously at least in the direction towards the upper side of the door operator 1 facing away from the mounting plate 2. Thereupon, the thus generated air stream impinges on an inner surface of the enclosure profile 89 and, on account of the suction effect of the fan 42, it is deviated in the direction of the motor 32.

On its further course, the air stream flows along and past the top of the connector module 3. A connecting circuit board 82, which has preferably terminals to the outside, for example for sensors and/or visual indicators which indicate for example the operational condition of the door operator 1, is preferably provided at the upper side of the connector module 3. Advantageously the air stream flows past the connecting circuit board 82 and thus provides cooling for the components on the connecting circuit board 82.

The connecting circuit board 82 is preferably coupled to the control unit 9, i.e. preferably to the circuit board carrier 20 thereof, by a flat cable 81. The connector module 3 and the motor flange 52 have preferably both flat cable guides 91, preferably in the shape of lateral projections protruding in the direction away from the mounting plate 2, and more preferably they have slide-in or clamping projections conformed to the free ends and pointing towards each other. The flat cable 81 can thus be inserted, or clamped between the slide-in or clamping projections and the respective member 3, 52.

The gear 41, respectively the housing thereof, has preferably a support 92, in the shape of a level surface, for the flat cable 51.

The lateral projections preferably have a predetermined distance, in a direction away from each other, to the enclosure profile 89. The air stream is thus guided past the lateral projections and the flat cable 82.

The drawn-in air is thereby forced to flow past both the gear 41, respectively the housing thereof, and the motor 32, and is able to effect its cooling action at this location as well. Thereby, the heat generated in the gear 41 and/or in the motor 32 can be effectively dissipated.

On account of the exterior shape of the reception tunnel 33 of the system carrier 6, the air stream is guided advantageously past the reception tunnel 33 in the direction of the power supply unit 8. The adjusting device 70 may fulfill a similar function. The voltage supply line 55 and/or the grounding line 84, which are/is laterally installed at the system carrier 6, may have a similar effect.

In the following course, the drawn-in air flows in the direction of the power supply unit 8 and advantageously past the control unit 9 such that the latter is cooled as well.

With its end, extending like a bow in the direction of the mounting plate 2 in the area of the control unit 9, the flat cable 81 preferably ensures that the air stream is deviated in the direction of the power supply unit 8. In particular the ventilation slots 47 of the above described reception element 14 ensure that the drawn-in air can flow, past the components of the power supply unit 8, to the fan 42 and is thus able to cool the power supply unit 8 as well.

Eventually the air stream exits the ventilation opening 83 of the system carrier 6 and leaves the door operator.

Advantageously, front side enclosure shielding parts, non-illustrated in the Figures, have through-openings through which the air is sucked-in, respectively dissipated. The enclosure shielding parts are preferably mounted to the enclosure profile 89, and it is furthermore preferred they are mounted in a sealing manner.

As suggested in FIG. 15, the enclosure profile 86 is preferably sealingly seated at adjoining lateral borders of the mounting plate 2. This circumstance makes sure that the air can only be drawn-in via the connector module 3, respectively the through-openings 90 configured thereat, and that the desired cooling air stream is generated.

It is thereby possible to protect the entire door operator 1 from overheating by a single fan 42, which results in a very simple and cost-effective cooling design.

Figure 16:
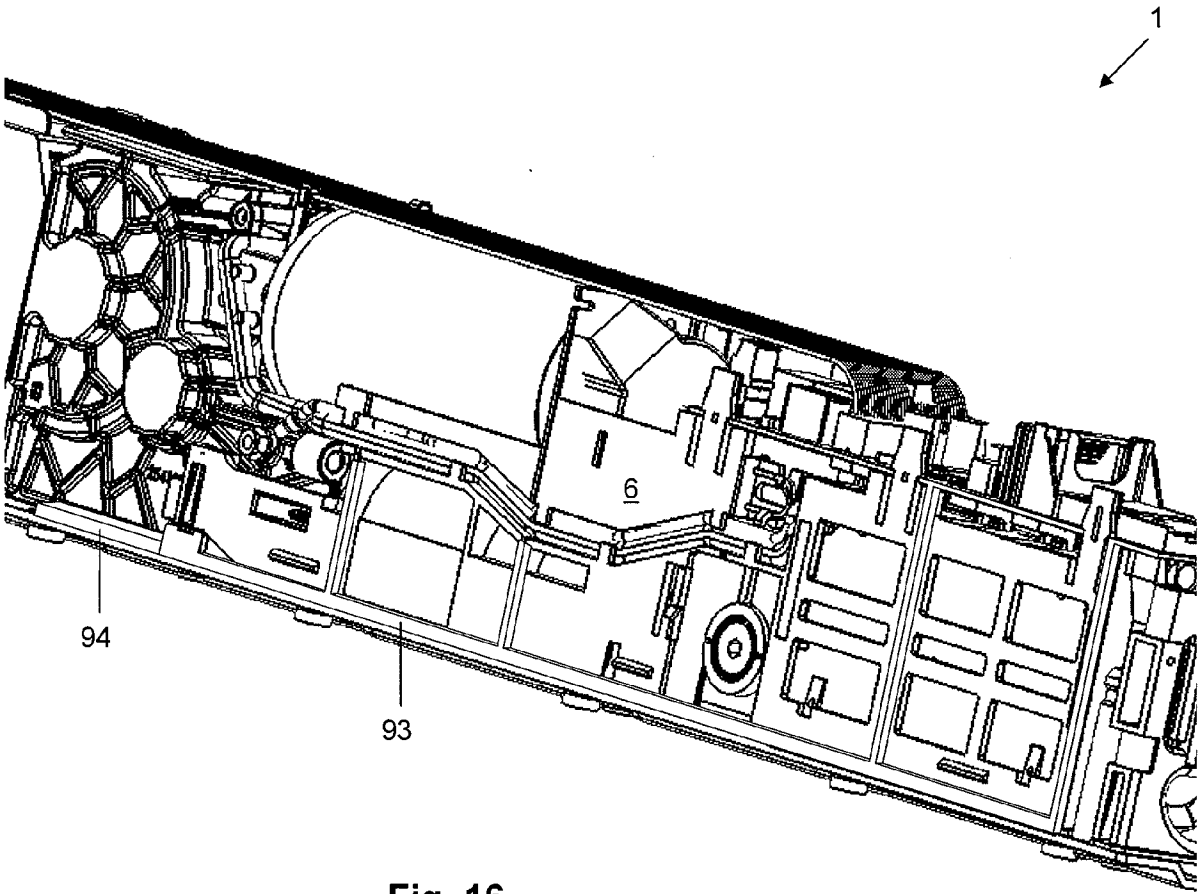
FIG. 16 is a detail of a modification of the door operator of FIG. 14.

FIG. 16 shows a modification of the door operator 1 of FIG. 14. Preferably both the system carrier 6 and the housing of the gear 41 preferably have wall sections 93, 94 at both long sides. In the installed condition, the herein non-illustrated enclosure profile 89 is located in a sealing manner at least at the surfaces of the wall sections 93, 94 facing the enclosure profile 89. The advantage of this solution is that the thereby formed sealing wall sections 93, 94 can provide wider sealing surfaces than the lateral borders of the mounting plate 2. It is thereby particularly simple to be able to mount non-illustrated sealing liners, such as felt, or also sealing profiles to the wall sections 93, 94 in order to increase or to achieve the sealing effect.

The invention in its configuration is not limited to the above presented preferred embodiment. On the contrary, a wide number of variants is conceivable, which make use of the described solution likewise with basically different types of configurations. All features and/or advantages including the constructional details, spatial dispositions and process steps, which result from the claims, the description or the drawings, may be essential to the invention, both by themselves and in their most various combinations. A mounting of all components of the assembly on the mounting plate 2, which is exclusively done via latching elements, is implemented in the inventive configuration of the door operator 1. The modules 3, 4 and 5 may be either latched onto each other, or the modules 3, 4 and 5 can also be latched onto the mounting plate 2 in the respective manner. In particular latching the drive module 4 onto the mounting plate 2 may be realized, which is not shown in detail in the aforementioned embodiments. The final screw connection via the screw receptions 13 at the modules 3, 4 and 5 serves for the final force absorbing connection between the modules 3, 4 and 5 and the mounting plate 2.

Obviously, the above described latching connections may be configured such that the latching projections and latching recesses can be exchanged or combined with each other such that for example the system carrier 6 has both latching recesses 16 and latching projections 15.

The latching connections and clamping connections, respectively clamping receptions may be functionally interchanged or combined with each other. The screw receptions 13 themselves for example may not be able to clamp the screws; however, latching projections may be provided at their border facing the mounting plate, in order to prevent the associated attachment screw 44 from falling out. Thereby, attachment screws 44 with a non-circular screw head could be utilized.

The projections 53, 54 for running the voltage supply line 55 may be likewise interchanged.

The pilot pins 23 allow furthermore to package the door operator 1 placed on the mounting plate 2, such as if it were installed. Thus, the door operator takes the least amount of space.

As a result, the invention provides a door operator 1 with a relatively simple assembly and very advantageous installation.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A modular door operator disposed at a reception body comprising at least one of a door leaf, a door frame, a door transom, and a wall, the door operator comprising:

at least one mounting plate configured for attachment to the reception body;

at least one connector module latched onto the mounting plate;

a drive module latched onto the mounting plate; and a main module latched onto the mounting plate the main module comprising:

a system carrier;

at least one supply unit received in the system carrier by a respective fastening element; and at least one control unit received in the system carrier by a respective fastening element; and at least one fastening element provided between the connector module, the drive module, and the main module, configured to provide at least one of clamping and latching of the respective modules to each other.

2. The door operator according to claim 1, wherein respective associated screw connections are provided between the drive module, the main module, and the mounting plate, which screw connections have captively disposed screw elements retained by respective screw receptions.

3. The door operator according to claim 1, wherein the supply unit is configured as a power supply unit, and a reception element in which the power supply unit is placed and, from a direction of the mounting plate, is disposed at the system carrier by latching elements that comprise at least one of a latching nose and an associated latching recess at the reception element and correspondingly at least the other of one latching recess and latching nose at the system carrier, wherein the reception element is one of angular and basket-shaped.

4. The door operator according to claim 1, wherein the control unit, is latched on the system carrier by latching elements, wherein the latching elements comprise one of arresting projections and recesses at the system carrier; and the other of recesses and arresting projections in a circuit board carrier of the control unit.

5. The door operator according to claim 4, wherein the latching projections of the latching elements comprise joining slants configured to slide along a border of the circuit board carrier when placing the circuit board carrier in a fitting direction of the circuit board carrier, the latching elements extending further in a direction of the circuit board carrier to resiliently push the arresting projections, laterally with regard to a joining direction, away from the border.

6. The door operator according to claim 4, wherein the arresting projections are undercut by respective adjacent holding recesses, in which at least one of the circuit board carrier and the system carrier is latchable.

7. The door operator according to claim 6, wherein the system carrier comprises a plurality of carrying projections at an upper side on which the circuit board carrier abuts when the arresting projections are latched in the holding recesses.

8. The door operator according to claim 7, wherein the latching elements for latching the modules on the mounting plate comprise pilot pins, which are disposed on the mounting plate and vertically protrude from the mounting plate.

9. The door operator according to claim 8, wherein the modules have pilot pin receptions that are complementary to the pilot pins, into which the pilot pins to extend.

10. The door operator according to claim 9, wherein the pilot pins have one of respective latching recesses and latching projections, and the pilot pin receptions have correspondingly configured the other of the latching projections and the latching recesses, such that the latching projections are latched in corresponding latching recesses.

11. The door operator according to claim 1, wherein at least one of the drive module and the system carrier comprises at least one of fastening and clamping elements configured to hold a section of a voltage supply line run from the connector module to the supply unit.

12. The door operator according to claim 1, wherein the door operator comprises a spring force accumulator configured to close a connected door, and the system carrier comprises fastening elements, configured to stationarily receive a device for adjusting a pretension of a closer spring of the spring force accumulator.

13. The door operator according to claim 12, wherein the spring force accumulator comprises:

a first transmission device, comprising:

a shaft that comprises a threaded section facing the closer spring;

a first gear member, disposed in a torque-proof manner at an end of the shaft, which is accessible with regard to the spring force accumulator; and a spring abutment screwed onto the threaded section of the shaft, at which an end of the closer spring is supported.

14. The door operator according to claim 13, wherein the closer spring pre-tension adjusting device that is in operative engagement with a first gear member comprises:

a mounting bracket having at least one fastening element configured to be stationarily mounted to a respective fastening element of the system carrier.

15. The door operator according to claim 14, wherein the at least one fastening element is formed by a slide-in projection, and the respective fastening elements are configured by a corresponding groove.

16. The door operator according to claim 15, further comprising a plate-shaped member mounted to the mounting bracket that extends transversely to a longitudinal extension of the spring force accumulator and has the at least one fastening element at a side arranged adjacent to the system carrier.

17. The door operator according to claim 16, wherein the mounting bracket has at least one wall, and a shaft of the adjusting device is freely rotatably supported and received in the at least one wall section, the shaft comprising:

a torque-proof disposed second gear member of the adjusting device arranged at one end of the shaft, facing an inner compartment of the mounting bracket in rotational engagement with the first gear member, and a torque-proof adjusting element at its other end facing away from the inner compartment of the mounting bracket.

18. The door operator according to claim 1, wherein the fastening elements comprise:

at least one slip-on projection at one of the connector module or the drive module; and at least one slip-on recess at the other of the drive module, into which recess the slip-on projection can be inserted from a joining direction.

19. The door operator according to claim 1, wherein the fastening elements, between the drive module and the main module, comprise at least one latching projection at the drive module, and correspondingly at least one latching tongue at the main module, which tongue connects the drive module to the main module by latching onto the latching projection.

20. The door operator according to claim 1, further comprising a cooling system configured to cool heat-generating components of the door operator.

21. The door operator according claim 20, further comprising at least one active fan.

22. The door operator according to claim 21, wherein the at least one active fan produces an air stream when activated, and the door operator is configured to guide the air stream past the heat-generating components.

23. The door operator according to claim 22, wherein the active fan is disposed at an end of the door operator facing away from the connector module, and draws-in air from a direction of the connector module.

24. The door operator according to claim 23, wherein one of the system carrier and a housing of a gear of the drive module comprises wall sections that:

are configured at a long side of the system carrier, respectively of the housing, have a continuous surface configured such that a respective surface of the wall sections comes to bear against an enclosure profile in a sealing manner.

25. The door operator according to claim 1, further comprising logic circuitry implemented in the door operator for enabling functions in the door operator.

* * * * *